US008763309B2

(12) United States Patent
Griffis et al.

(10) Patent No.: US 8,763,309 B2
(45) Date of Patent: Jul. 1, 2014

(54) DEPLOYABLE AND INFLATABLE ROOF, WALL, OR OTHER STRUCTURE FOR STADIUMS AND OTHER VENUES

(71) Applicants: Lawrence Glen Griffis, Austin, TX (US); Mark Clinton Waggoner, Austin, TX (US)

(72) Inventors: Lawrence Glen Griffis, Austin, TX (US); Mark Clinton Waggoner, Austin, TX (US)

(73) Assignee: Walter P. Moore & Associates, Austin, TX (US)

( * ) Notice: Subject to any disclaimer, the term of this patent is extended or adjusted under 35 U.S.C. 154(b) by 0 days.

(21) Appl. No.: 13/910,803

(22) Filed: Jun. 5, 2013

(65) Prior Publication Data

US 2013/0318885 A1 Dec. 5, 2013

Related U.S. Application Data

(60) Provisional application No. 61/655,717, filed on Jun. 5, 2012.

(51) Int. Cl.
*E04G 11/04* (2006.01)
*E04H 15/20* (2006.01)

(52) U.S. Cl.
USPC ..... 52/2.11; 52/2.16; 52/2.18; 52/2.19; 52/2.24

(58) Field of Classification Search
USPC ..... 52/2.11, 2.16, 2.18, 2.19, 2.24
See application file for complete search history.

(56) References Cited

U.S. PATENT DOCUMENTS

| | | | | | |
|---|---|---|---|---|---|
| 3,619,957 | A * | 11/1971 | Adam | 52/2.21 |
| 4,160,523 | A * | 7/1979 | Stevens | 126/625 |
| 4,192,105 | A * | 3/1980 | Morgan | 52/2.25 |
| 4,257,199 | A * | 3/1981 | Kuboyama | 52/2.17 |
| 4,936,060 | A * | 6/1990 | Gelinas et al. | 52/1 |
| 5,097,548 | A * | 3/1992 | Heck et al. | 5/482 |
| 6,282,842 | B1 * | 9/2001 | Simens | 52/2.11 |
| 6,332,290 | B1 * | 12/2001 | Delamare | 52/2.22 |
| 6,415,556 | B1 | 7/2002 | Silberman et al. | |
| 6,453,619 | B1 * | 9/2002 | Delamare | 52/2.11 |
| 6,789,360 | B2 | 9/2004 | Silberman et al. | |
| 7,434,356 | B2 * | 10/2008 | Morris | 52/2.11 |
| 2004/0031207 | A1 * | 2/2004 | Fleming | 52/2.11 |
| 2007/0017164 | A1 | 1/2007 | Silberman et al. | |
| 2007/0094937 | A1 * | 5/2007 | Pedretti | 52/2.11 |

* cited by examiner

*Primary Examiner* — Mark Wendell
(74) *Attorney, Agent, or Firm* — Wong, Cabello, Lutsch, Rutherford & Brucculeri, LLP.

(57) ABSTRACT

A deployable and inflatable roof, wall, or other structure has first and second covers made of flexible panels and cables arranged from edge to edge along the covers. Couplings along the edges of the covers connect the structure to supports, such as rails on which the structure can deploy and other supports of a building. Air from blowers blow air in between the covers to inflate the structure like an air cushion. In addition to cables, lateral support for the structure can use struts disposed edge to edge along the covers. Traction or rack and pinion drive mechanisms or cable drive systems can be used to deploy and retract the structure along the rails to cover or open a rooftop or other opening or area of the building.

36 Claims, 29 Drawing Sheets

INFLATED CONDITION

DEPLOYABLE AND INFLATABLE ROOF, WALL, OR OTHER STRUCTURE FOR STADIUMS AND OTHER VENUES

CROSS-REFERENCE TO RELATED APPLICATIONS

This is a non-provisional of U.S. Provisional Appl. 61/655,717, filed 5 Jun. 2012, which is incorporated herein by reference in its entirety.

BACKGROUND OF THE DISCLOSURE

Popular sport stadiums and other venues use retractable roofs so they can remain open when weather permits and can be closed when conditions warrant. The retractable roofs for these venues use large, cumbersome roof members that require extensive structures to support and move over the open roof area.

Facilities, such as stadiums, convention centers, gyms, and the like, can also benefit from retractable walls and other dividers so various areas of the facility can be separated from one another. Storing retractable structures to be used as walls or dividers for large areas of a facility can be cumbersome and take an undesirable amount of floor area.

The subject matter of the present disclosure is directed to overcoming, or at least reducing the effects of, one or more of the problems set forth above.

SUMMARY OF THE DISCLOSURE

A deployable and inflatable roof, wall, or other structure has first and second covers made of flexible panels and cables arranged from edge to edge along the covers. Couplings along the edges of the covers connect the structure to supports, such as rails on which the structure can deploy and other supports of a building. Air from blowers blow air in between the covers to inflate the structure like an air cushion. In addition to cables, lateral support for the structure can use struts disposed edge to edge along the covers. Traction or rack and pinion drive mechanisms or cable drive systems can be used to deploy and retract the structure along the rails to cover or open a rooftop or other opening or area of the building.

In one embodiment, the structure to cover an exposed area of a facility has a flexible first cover and has a flexible second cover disposed adjacent the flexible first cover. A plurality of lateral supports extend from edge to edge along the flexible first and second covers, and couplings disposed along the edges of the flexible first and second covers are connected to ends of the lateral supports. The flexible first and second covers define at least one plenum adapted to inflate the flexible first and second covers relative to one another.

The structure can deploy as a roof to cover the exposed area of the facility. Therefore, the flexible second cover is a bottom cover disposed beneath a flexible top cover as the flexible first cover. In an alternative, the structure can deploy as a wall to cover the exposed area of the facility.

In another embodiment, the structure to cover an exposed area of a facility includes a plurality of lateral supports arranged side-by-side on the structure. A plurality of flexible panels are disposed laterally between adjacent ones of the lateral supports. Each of the flexible panels has flexible first and second covers that define a plenum adapted to inflate the flexible first and second covers relative to one another. Longitudinal support rails extend along longitudinal edges of the structure, and couplings disposed at least on the lateral supports are movable on the lateral longitudinal support rails.

In one method of covering and uncovering an exposed area of a facility, the exposed area is uncovered by deflating interconnected lateral panels of a flexible structure. The deflated lateral panels of the flexible structure are stacked in a retracted condition relative to the exposed area by running the deflated lateral panels along longitudinal rails. To cover the exposed area, the deflated lateral panels are spread over the exposed area by running the interconnected lateral panels from the retracted condition along the longitudinal rails and by inflating the interconnected lateral panels of a flexible structure.

The foregoing summary is not intended to summarize each potential embodiment or every aspect of the present disclosure.

BRIEF DESCRIPTION OF THE DRAWINGS

FIGS. 15A-5B show bogeys for use in moving the couplings of the deployable structure on a rail.

DETAILED DESCRIPTION OF THE DISCLOSURE

Figure 1A:
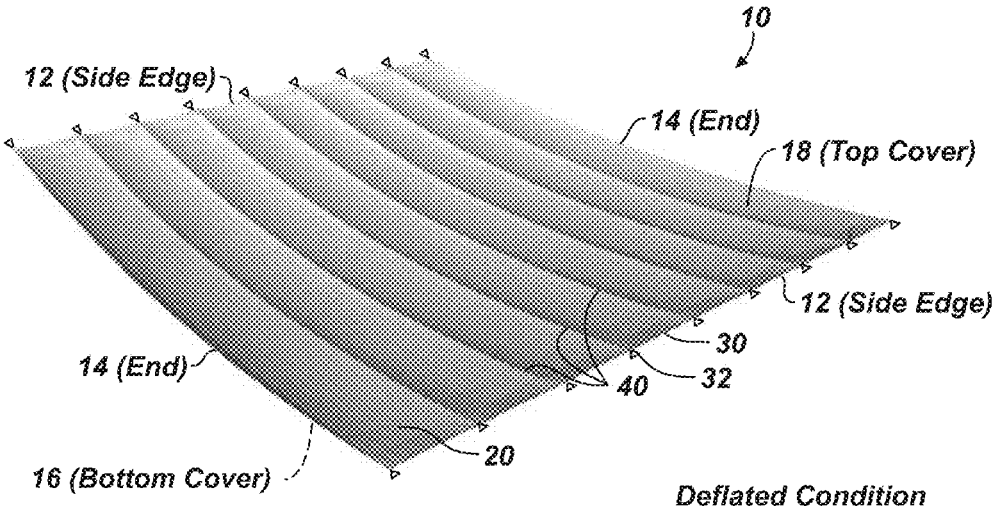
FIG. 1A is a perspective view of a deployable structure in a deflated condition.
Figure 1B:
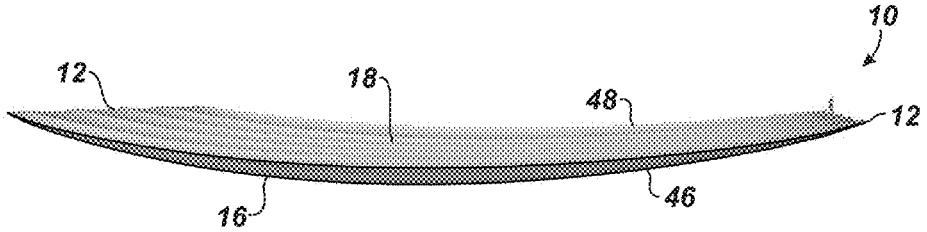
FIG. 1B is an end view of the deployable structure in the deflated condition.
Figure 2A:
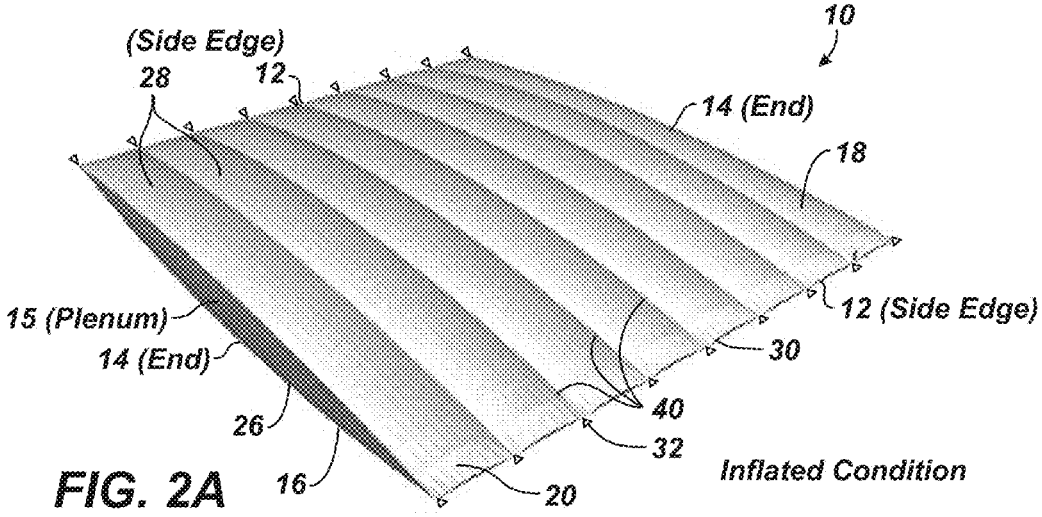
FIG. 2A is a perspective view of the deployable structure in an inflated condition.
Figure 2B:
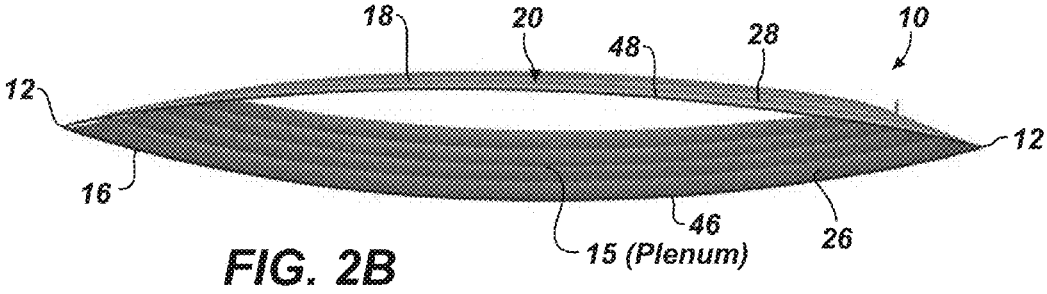
FIG. 2B is an end view of the deployable structure in the inflated condition.
Figure 2C:
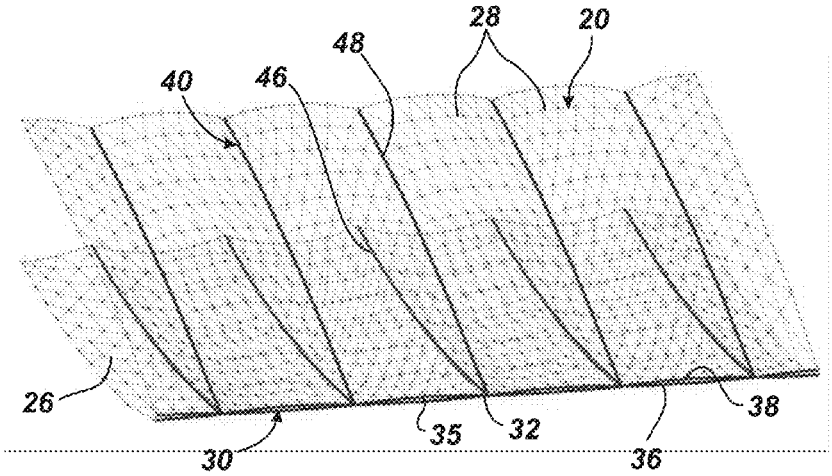
FIG. 2C is a perspective view of a section of the deployable structure in an inflated condition.

A deployable and inflatable structure 10 according to the present disclosure is shown in a deflated condition in FIGS. 1A-1B and in an inflated condition in FIGS. 2A-2C. In general, the structure 10 can be used as a roof, wall, or the like to cover an exposed area of facility, including, but not limited to, buildings, shopping malls, restaurants, swimming pools, patios, industrial facilities, outdoor theaters, sports stadiums, and other venues. Accordingly, the structure 10 used as a roof can cover rooftop openings in such exposed facilities or may be used to cover an open-air area of such facilities.

The structure 10 has two opposing side edges 12 and two opposing ends 14, a flexible bottom cover 16, and a flexible top cover 18. When disposed to cover an exposed area of a facility (not shown), the flexible bottom cover 16 is disposed beneath the flexible top cover 18.

External supporting structure of the deployable structure 10 is not shown in FIGS. 1A-1B and 2A-2C, but details are provided below. Yet, some internal support structures are shown. In particular, a plurality of lateral supports 40 extend from side edge 12 to side edge 12 along the flexible top and bottom covers 16 and 18. Here, these supports 40 include cables or strands 46 and 48 for the top and bottom covers 16 and 18. Ends of these cables 40 connect to coupling points 32 disposed along the side edges 12 of the flexible top and bottom covers 16 and 18.

The flexible top and bottom covers 16 and 18 can each be composed of one or more sheets or membranes of material, depending on the size of the deployable structure 10 and size of sheets or membranes used. Thus, multiple sheets or membranes can be affixed together to form the entire top or bottom cover 16 or 18. Preferably, as shown in FIGS. 1A through 2C, the deployable structure 10 is formed by a plurality of individual membrane panels 20 attached to, and supported by, a network of cables or strands 30 and 40 to form the top and bottom covers 16 and 18. The cables 30 and 40 are composed of steel and may be wire rope cables (conforming to ASTM A603) or structural strand cables (conforming to ASTM A586). Preferably, the cables 30 and 40 are coated to a Class A zinc coating (or higher rated coating if desired) as suitable for exterior exposure.

The edges of the membrane panels 20 attach to the cables 30 and 40 using structural clamping systems (not shown), which may use structural aluminum and stainless steel connectors. Details related to such a clamping system are discussed later. In general, galvanized, swaged end-fittings or speltered end-fittings can be used to connect the ends of the cables 30 and 40 together. Overall, any connecting hardware and connectors are preferably made up of stainless steel and aluminum components for corrosion resistance.

As shown more particularly in FIGS. 2B and 2C, top and bottom panels 26 and 28 are arranged laterally from side-to-side across the deployable structure 10, and the edges of the panels 26 and 28 couple to laterally arranged top and bottom cables 46 and 48. The top cables 48 anchor the top cover 18 of the deployable structure 10, and the bottom cables 46 anchor the bottom cover 16 of the deployable structure 10. The side edges 12 of the deployable structure 10 have the side cables 30 that run along the ends of the panels 20.

Figure 2D:
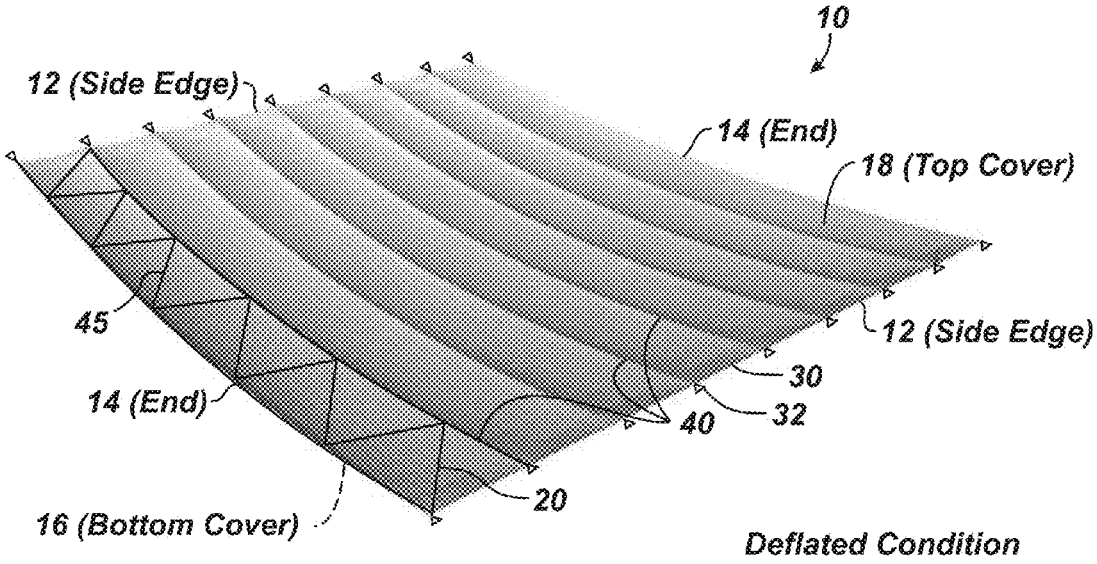
FIG. 2D is a perspective view of the deployable structure in an inflated condition and having reinforcement strands in the end bay.

For additional support and as shown in FIG. 2D, the deployable structure 10 can have reinforcement strands 45 interconnected between the lateral cables 40. (For simplicity, only strands 45 are shown for one panel 20, although it is understood that all or just some of the panels 20 may have such strands 45 supported between adjacent cables 40.) These strands 45 can be composed of the same material and may or may not be of comparable diameter. The strands 45 can be arranged as shown, in a lattice structure, or any other suitable pattern.

As discussed in more detail below, the structure 10 can be inflated and deflated when air is pumped in between the covers 16 and 18. Therefore, the flexible top and bottom covers are adapted to inflate relative to one another. As best shown in the deflated condition of FIG. 1B, the bottom cables 46 have a greater catenary length than the top cables 48. Therefore, when the structure 10 is in the deflated condition (when the cables 40 hang as catenaries), the bottom and top cables 46 and 48 are separated a sufficient distance to keep the cables 46 and 48 from rubbing together and possibly damaging the membrane panels 20. As shown inflated in FIG. 2A-2B, air pressure supplied inside the plenum 15 between the bottom cover 16 and top cover 18 of the structure 10 inflates the structure 10. Due to the lenticular shape of the roof 10 and panels 20 when inflated as shown in FIGS. 2A-2B, the structure 10 forms an air cushion structure, and the various panels 20 may also be referred to as "pillows."

As best shown in FIG. 2C, the bottom and top cables 46 and 48 along with upper and lower side cables 36 and 38 connect at coupling points 32 along the sides of the structure 10. Various types of structures can be used at these coupling points 32 and particular embodiments are discussed below. The air used for inflating the structure 10 can be introduced in side gaps 35 between the side cables 36 and 38 or at other convenient locations as discussed below.

The structure 10 can deploy and retract across an opening in a fixed structure and can be ultimately inflated with air once fully deployed. The structure 10 utilizes low air pressure to support the bottom and top covers 16 and 18, while utilizing the high-strength capacity of the cable-supported panels 26 and 28 to span great distances with very low weight. In general, the weight of the combined supporting cables 30 and 40 and membrane panels 20 may typically range from 75 pascals to 150 pascals (approximately 1.5-3.0 psf).

The supporting cables 40 may be spaced at any convenient spacing that ranges from 3 meters to as much as 12 meters, depending on the tensile capacity of the tensioned membrane used. The sizes of the cables 40 may range from 20 mm to 100 mm (¾" to 4") in diameter, depending on the total span of the structure 10. Generally, the cables 40 are placed as far apart as the membrane panels 20 can span with the required building code under dead, live, wind, and snow loading conditions.

The roof's panels 20 may consist of one or more architectural fabric membranes that form the covers 16 and 18 of the structure 10 and create the air pillow. For example, the panels 20 may consist of vinyl-coated polyester (PVC), Teflon-coated fiberglass (PTFE), High-Density Polyethylene, or similar tensioned membranes used for building structures. Preferably, the membrane material is lightweight and may be less than 48 pascals, or one pound per square foot.

Figure 3A:
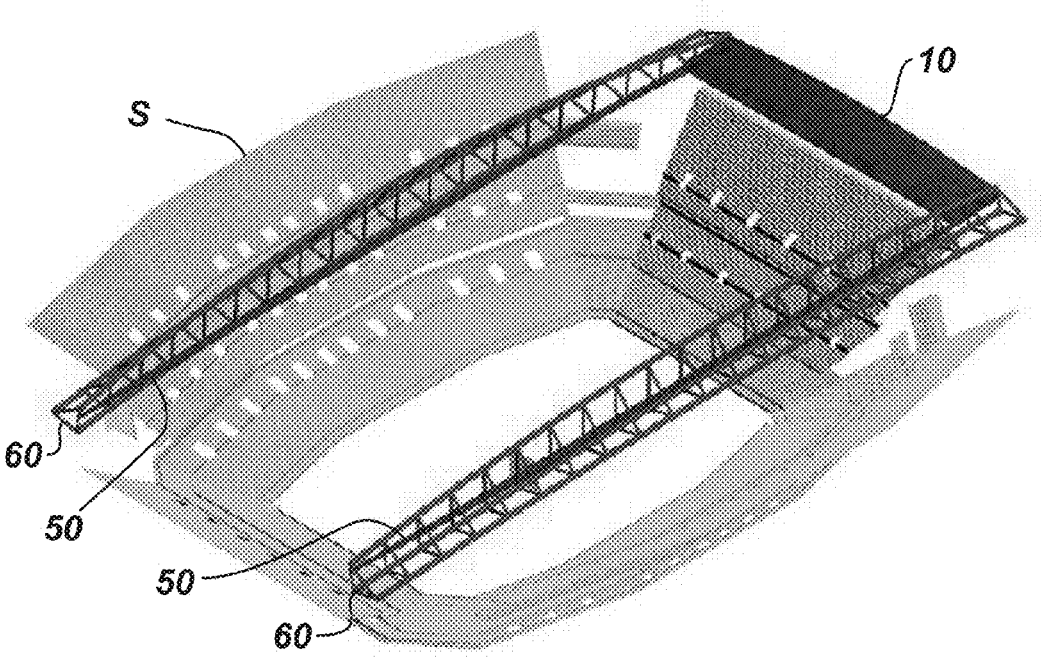
FIG. 3A is a perspective view of the deployable structure in a retracted condition as a roof on a supporting structure.
Figure 3B:
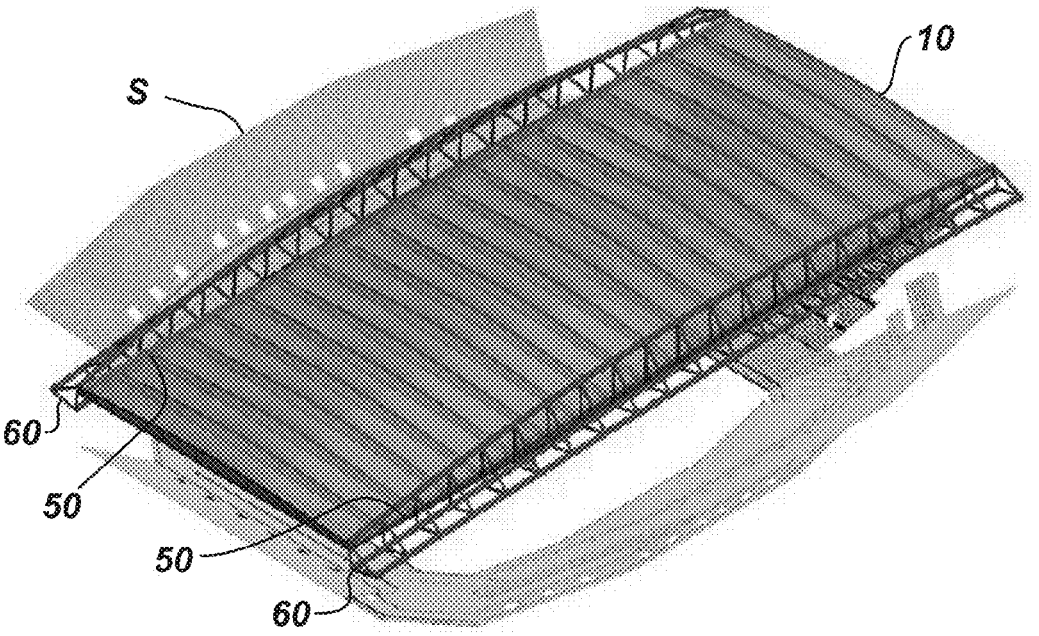
FIG. 3B is a perspective view of the deployable roof of FIG. 3A in a deployed condition on the supporting structure.

The deployable structure 10 is shown as a roof in a retracted condition on a building S in FIG. 3A and is shown in a deployed condition on the building in FIG. 3B. When retracted, the panels 20 and cables 30 and 40 fold up at one end of the building S along tracks or rails 50 affixed to supports 60 of the building S. This retracted condition exposes the rooftop opening of the building S.

When deployed, the panels 20 and cables 30 and 40 are moved along the tracks or rails 50 across the building S to close over the roof opening of the building S. In this deployed condition, the roof 10 is also inflated. The network of panels 20 and cables 30 and 40 act together in a synergistic way to support the weight of the roof 10 and all external loads. When the deployed roof 10 is positioned over the roof opening and is inflated, the resulting roof structure can support the self-weight of the roof 10 and all normal superimposed dead, live, wind and snow loads as specified by the building code.

In the roof's deflated condition (FIG. 3A), the flexible membrane panels 20 and cables 40 hang in catenary curves, and the roof 10 can be stored in a short stacking distance compared to its total deployed length across the building's roof opening. The ratio of covered roof length (when the roof 10 is closed and the panels 20 are inflated) to stacking length while stored (when the roof is open and the panels 20 are deflated and moved to a stacking position) can be as high as 8/1 or more. The roof 10 may be moved from the stored position to the open position by riding on a mechanized rail or track system 50, which is discussed in more detail below.

Figure 4A:
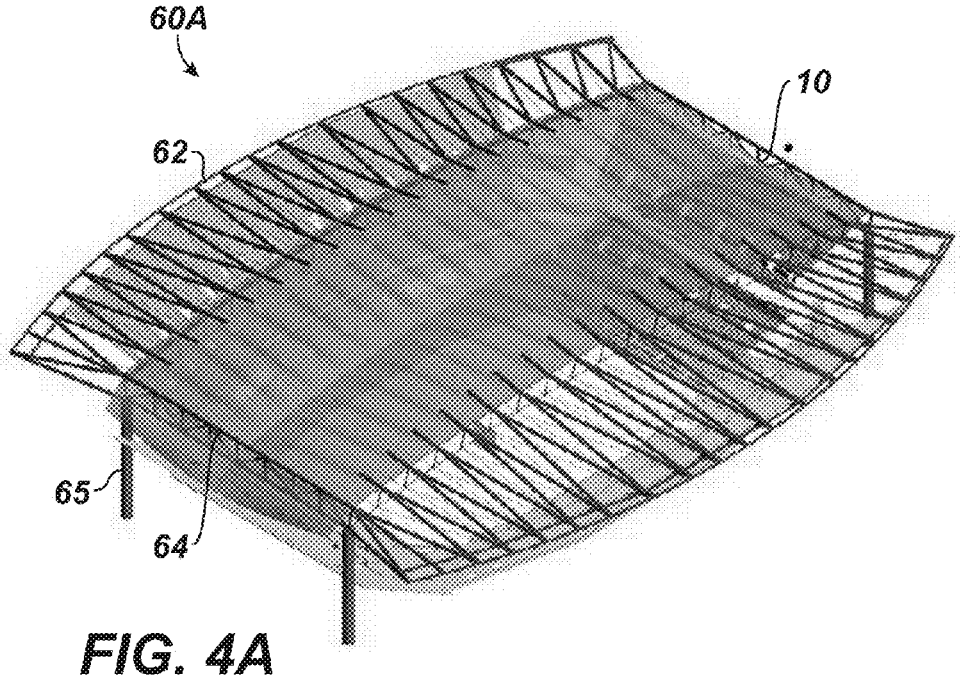
FIGS. 4A-4B show one type of support structure for supporting the deployable structure when used as a roof.
Figure 4B:
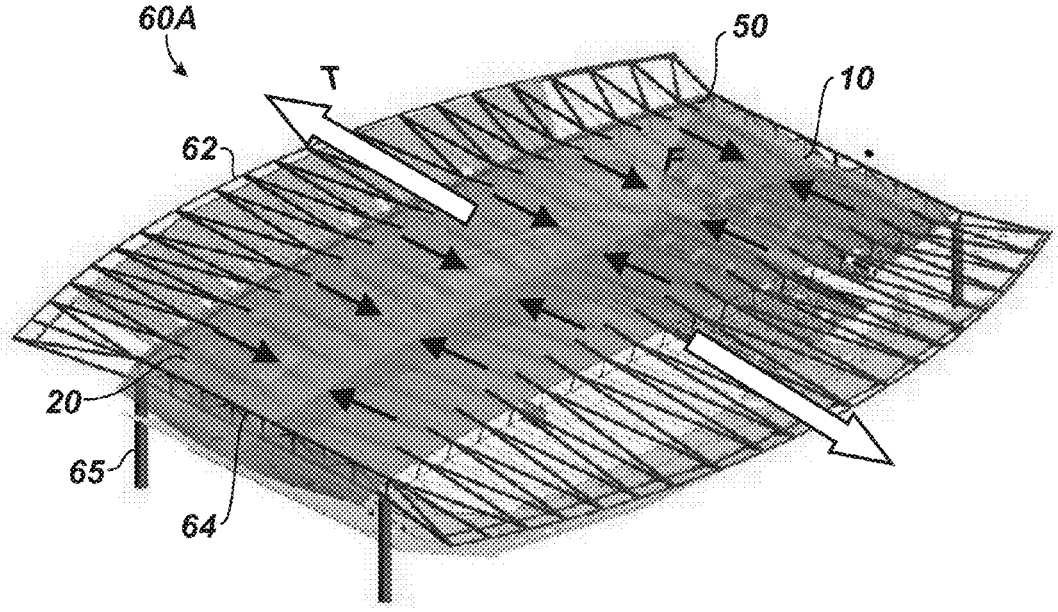
Figure 5A:
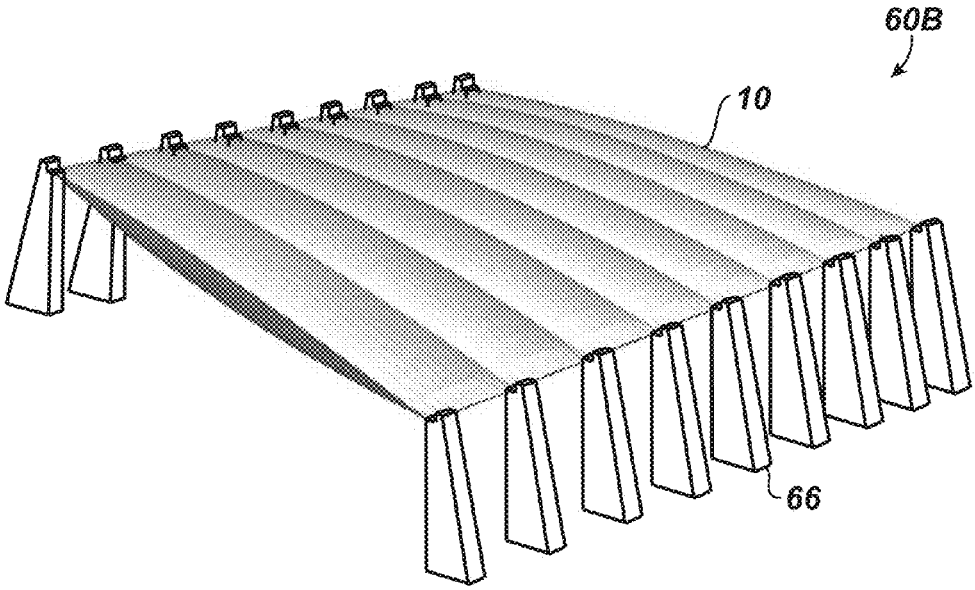
FIGS. 5A-5B show another type of support structure having buttresses for supporting the deployable structure when used as a roof.
Figure 5B:
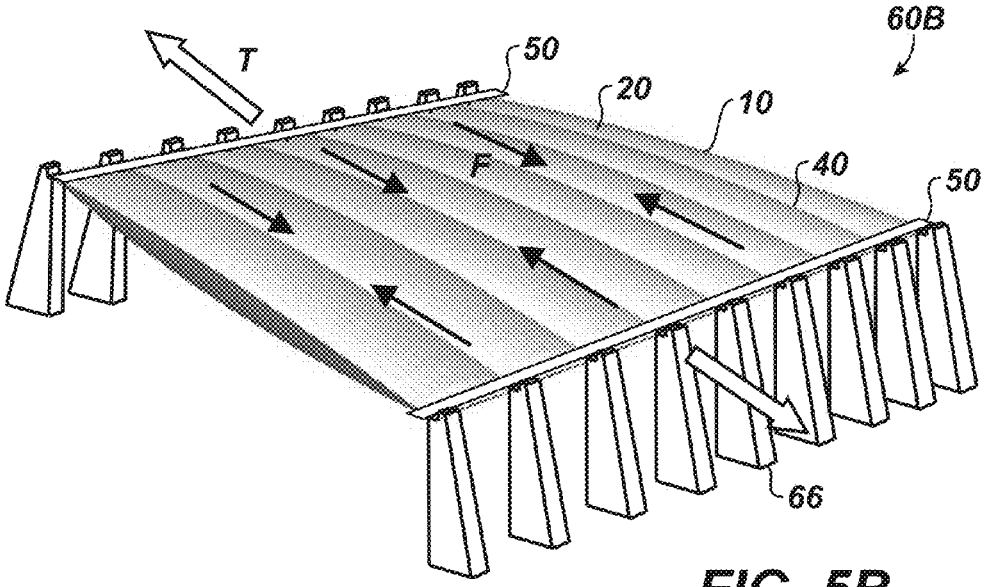
Figure 6A:
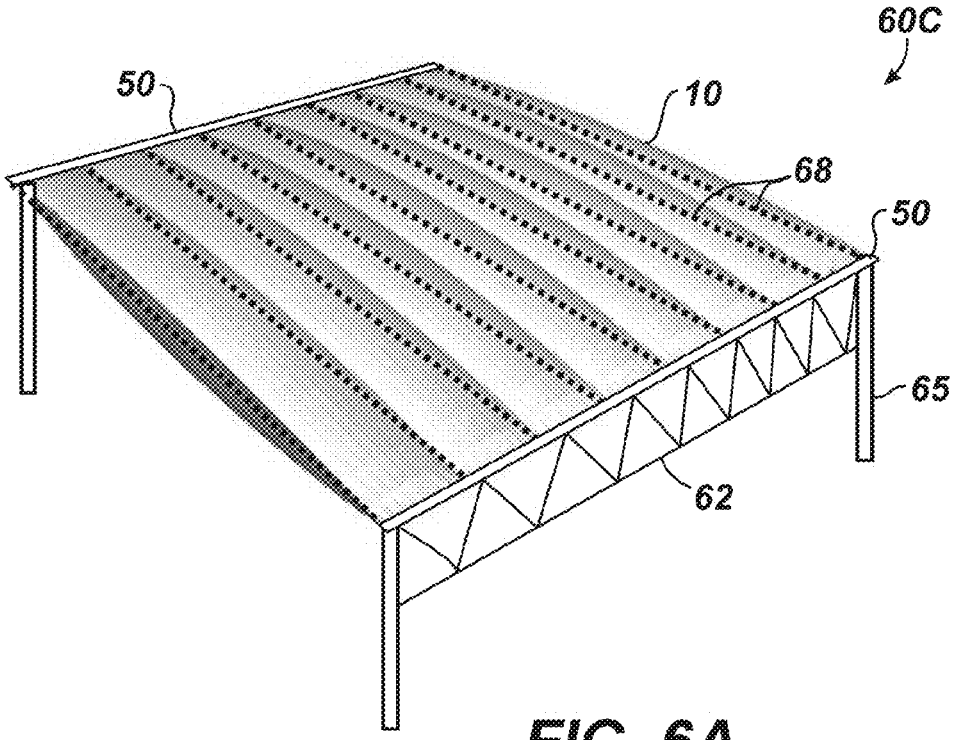
FIGS. 6A-6B show yet another type of support structure having trusses for supporting the deployable structure when used as a roof.
Figure 6B:
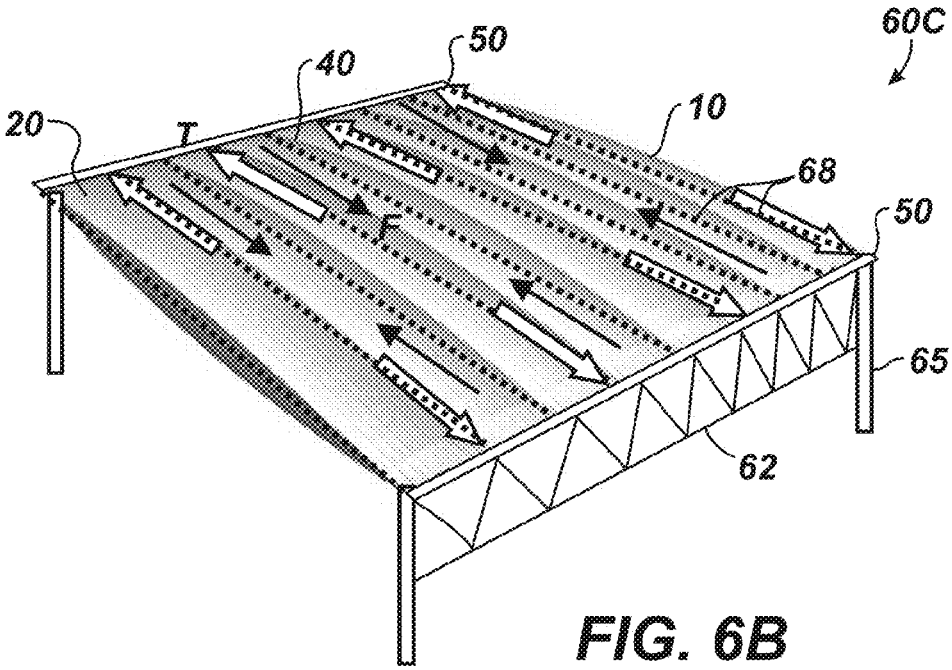

The structure 10 can be structurally supported as a roof in a variety of different configurations to suit building design requirements, some of which are shown in FIGS. 4A through 6B. The load path of forces is also shown in FIGS. 4B, 5B, and 6B for the different possible configurations of roof structure. The arrows T indicate the horizontal thrust exerted by the cables 40, while the arrows F indicate the resisting forces of the roof structure. For each option described, the roof's panels 20 are stored in a deflated position adjacent to the desired roof opening to be covered, mechanically moved into position along a rail or track (not shown) to the deployed position, and inflated to resist required roof loads.

As these configurations show, support of the roof 10 can be accommodated in many different ways to suit the architectural design and desired structural system used for the building. Basically, any supporting structure having steel, concrete, or a combination thereof can be used to support the deployable roof 10 of the present disclosure.

FIGS. 4A-4B show a support structure 60A for supporting the deployable structure 10 as a roof. Here, the support structure 60A has side struts 62, end struts 64, and vertical supports 65. The side and end struts 62 and 64 form a large opening to be covered by the deployable roof 10, and the vertical supports 65 are ground-supported. In this configuration, the roof's panels 20 and cables 30 and 40 are anchored on the rail or track system 50 at the edge of the opening where the side struts 62 connect. When the roof 10 is mechanically moved from its deflated and stored position to the deployed position as shown, the roof 10 is inflated to stress the panels 20 and cables 30 and 40. The resulting cable thrust T is resisted by the side struts 62 of the support structure 60A and by the end struts 64 across the opening. Thus, in this case, the support structure 60A is designed to carry the weight and horizontal thrust T of the roof 10.

FIGS. 5A-5B show another support structure 60B for supporting the deployable structure 10 as a roof. The roof's weight and cable thrusts T of the roof 10 are supported on the side track structure 50. From there, the loads are taken into external columns or buttresses 66 that are ground-supported.

FIGS. 6A-6B show yet another support structure 60C for supporting the deployable structure 10 as a roof. Here, the vertical loads of the roof 10 are supported on the side track 50 and struts 62 connected to the vertical supports 65, which are ground-supported. As opposed to having end struts (64: FIG. 4A-4B), the horizontal cable thrusts T are resisted using cross-opening struts 68 (lenticular trusses or beams) that resolve the forces F internally within the deployable roof 10 itself. This structural configuration is internally self-contained in so far as resolution of all horizontal cable forces F because the struts 68 are carried along with the panels 20 and cables 40 of the moving roof 10. There is no particular reliance on external structures beyond the boundaries of the moving roof 10 itself.

With an understanding of the deployable structure 10 and its structural support, discussion turns to additional details below.

Figure 7A:
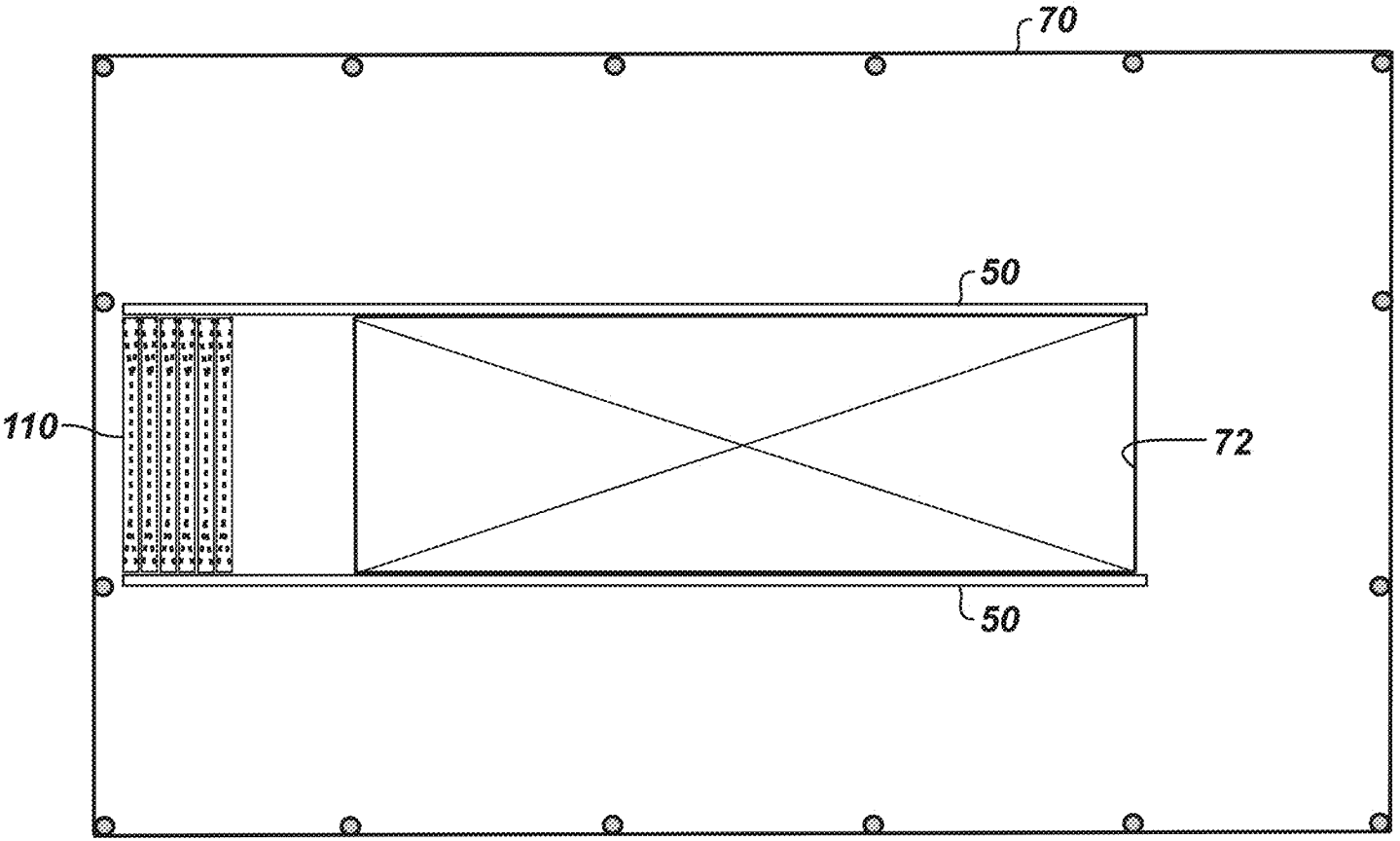
FIG. 7A is a plan view of a support structure having a deployable structure in the form of a roof in a retracted condition.
Figure 7B:
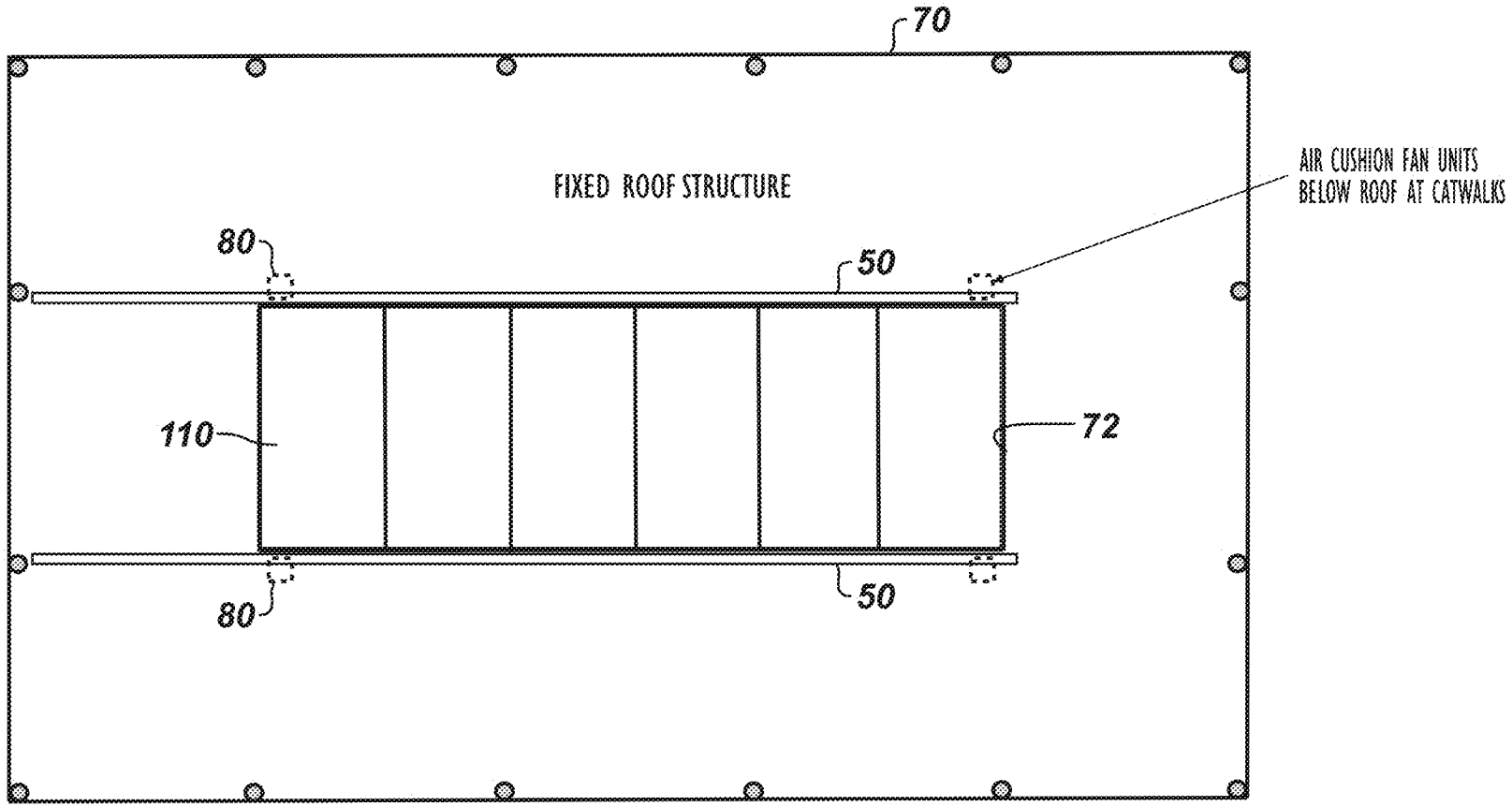
FIG. 7B is a plan view of the support structure in FIG. 7A having the deployable roof in a deployed condition.

FIG. 7A is a plan view of a support structure 70 having a deployable structure 110 in the form of a roof in a retracted condition, while FIG. 7B is a plan view of the support structure 70 having the deployable roof 110 in a deployed condition. As previously noted, the roof 110 can retract and deploy along tracks or rails 50 supported by the support structure 70. In the retracted position (FIG. 7A), the deployable roof 110 folds up and preferably fits under part of the support structure 70 or some other cover for protection. When deployed (FIG. 7B), the roof 110 extends along the tracks 50 and across the rooftop opening 72 in the structure 70. Once deployed, the roof 110 is inflated using a plurality of fan or blower units 80 situated below the rooftop opening 72.

In general, the deployable roof 110 can be designed to span distances as short as 10 meters (33 feet) or as long as 400 meters (1,312 feet) or more.

As shown in FIG. 7A, the roof's panels 20 are stored adjacent to the rooftop opening 72 to be covered while the roof 110 is in a deflated condition. While still in the deflated condition, the panels 20 are moved into position along the rail or track system 50 using a mechanized system (not shown), which is not shown here but is described below. Regardless of which structural option and mechanized system are used for the roof 110 as disclosed herein, the procedure to open and close the deployable roof 110 can be the same. As shown in FIG. 7A, the roof 110 is stored in its deflated condition adjacent to the rooftop opening 72 to be covered. Normally, this would be in a position below a portion of a roof cover adjacent to the rooftop opening 72 to protect the deflated roof 110 from exposure to sun, wind, rain, and snow.

To close the rooftop opening 72, the roof 110 is mechanically moved along the rail or track system 50 while the roof 110 remains in its deflated condition. Eventually, the roof 110 reaches its final prescribed position covering the rooftop opening 72. At this point, communication elements, such as hoses, conduits, piping, or the like, are attached from fan units 80 to side openings in the roof's panels 20. The fan unit 80 can be disposed above catwalks attached to the support structure 70. Each side opening in the roof panels 20 may have a fan unit 80, or only some but not all may have a unit 80 depending on the size of the roof 110, the capacity of the fan units 80, and other factors.

As the fan units 80 operate, the panels 20 of the roof 110 are pressurized to the desired air pressure as required by the structural design to resist prescribed loads. The fan units 80 can use conventional mechanical fan blowers to inflate the panels 20 to form the air cushions. The fan units 80 inflate the air cushions of the panels 20 to a relatively low pressure of 285 to 625 pascals (approximately 6 to 13 pounds per square foot). The air pressure from the fan units 80 stresses the membrane panels 20 and the cables 40 at the same time, which together provide the load carrying capacity of the roof 110. The magnitude of the inflation pressure is dependent upon external load requirements, which are typically the magnitude of the building code prescribed loads, including the live load, the wind load, and snow load for which the roof 110 is designed. The light weight may make the roof 110 ideal for high seismic zones as well. The total width of any one of the air cushion panels 20 is dependent upon the desired size and spacing of fan units 80, as well as the most convenient panel size to be fabricated, erected and inflated using a single fan unit 80.

As the roof 110 remains deployed and inflated, the panels 20 remain attached to the fan units 80 to maintain the prescribed air pressure within each panel 20. The deployable roof 110 remains in place covering the rooftop opening 72 as long as required for the particular program or event in the building or as desired by the building operator. When the particular event is over or whenever the building operator chooses, the roof 110 is deflated by releasing the air pressure from within the panels 20. Subsequently, the deployable roof 110 is mechanically moved back to its original stored position.

Figure 8A:
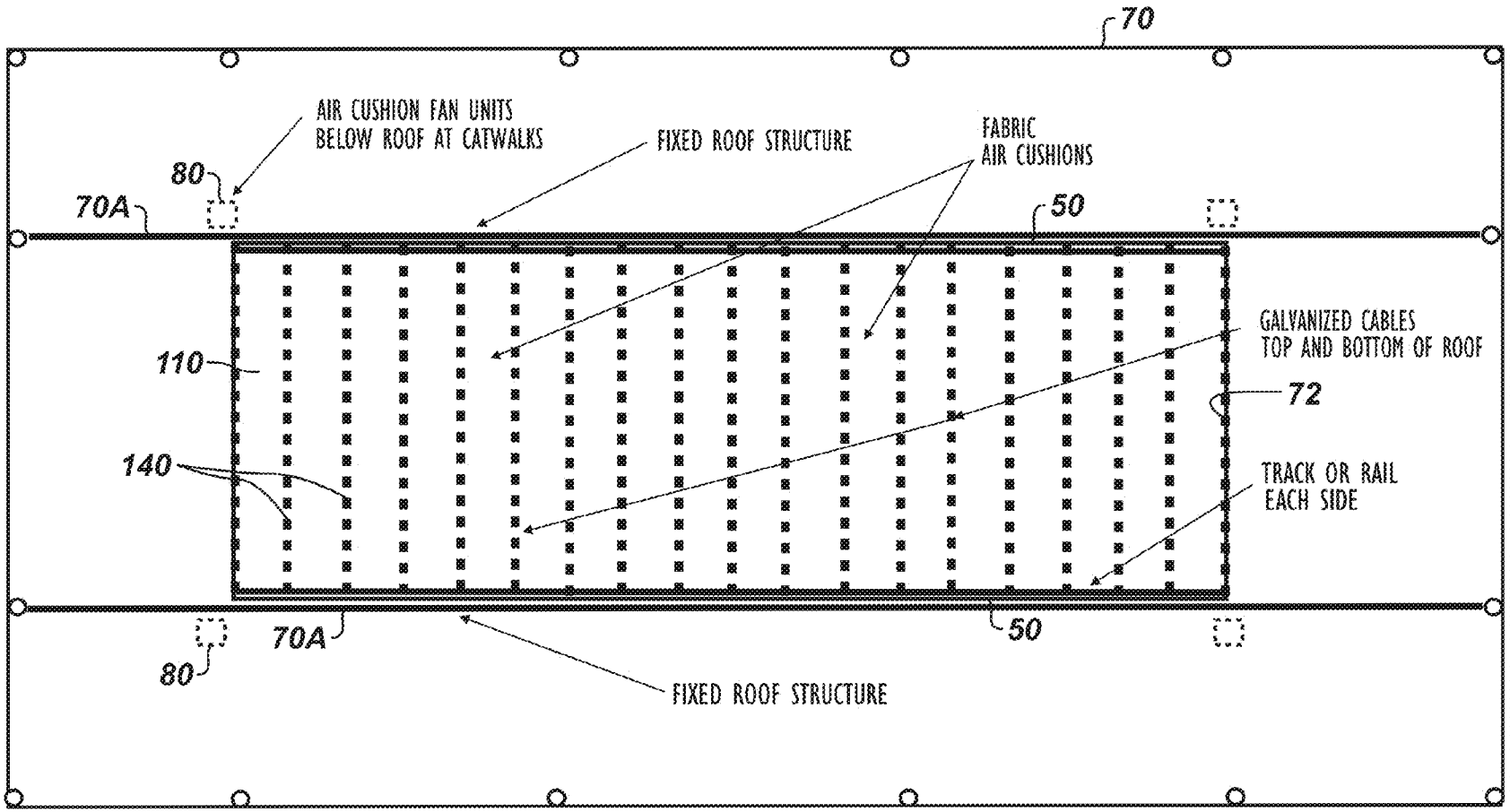
FIG. 8A is a plan view of a support structure supporting a deployable structure in the form of a roof in a deployed condition, wherein the deployable roof uses a plurality of lateral cables located top and bottom of the air cushion of the deployable roof.

As noted previously, the loads of the deployable roof 110 can be supported in a number of ways. For example, FIG. 8A is a plan view of a support structure 70A supporting a deployable structure 110 in the form of a roof in a deployed condition. As shown here, the deployable roof 110 uses a plurality of lateral cables 140. The sides of the roof 110 couple to the support structure 70A, which supports the roof's loads similar to the way discussed above in FIGS. 4A-4B.

Figure 8B:
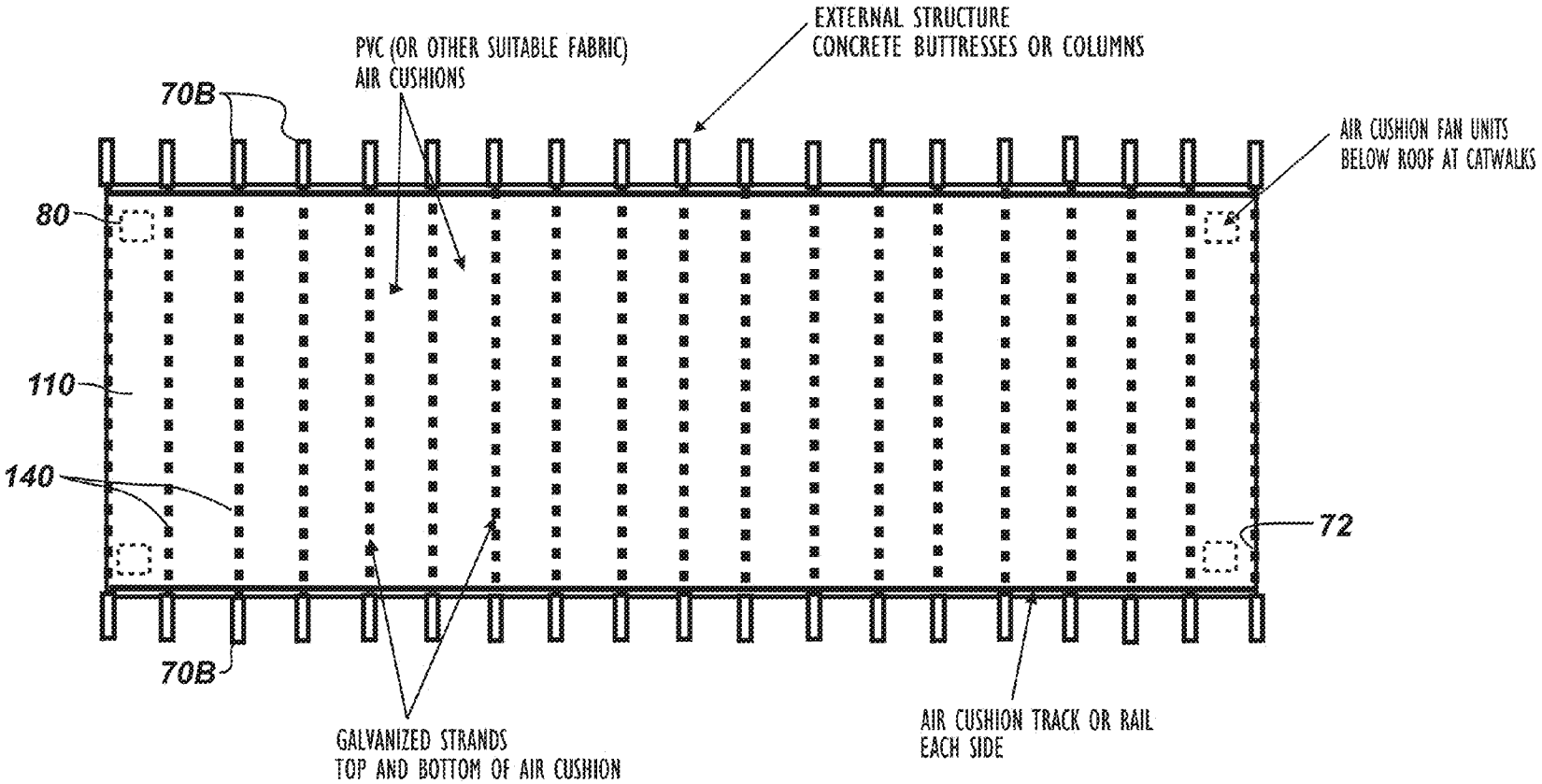
FIG. 8B is a plan view of a buttressed structure supporting the deployable structure in the form of a roof in the deployed condition, wherein the deployable roof uses the lateral cables located top and bottom of the air cushion of the deployable roof.

By contrast, FIG. 8B is a plan view of a buttressed structure 70B supporting the deployable structure 110 in the form of a roof in the deployed condition. Again, the deployable roof 110 uses the lateral cables 140. In this arrangement, the sides of the roof 110 couple to the buttresses 70B, which supports the roof's loads similar to the way discussed above in FIGS. 5A-5B. Details to the roof 110 with the lateral cables 140 and how they couple to either of these structures 70A-70B is discussed below with reference to FIGS. 9A-9C.

Figure 9B:
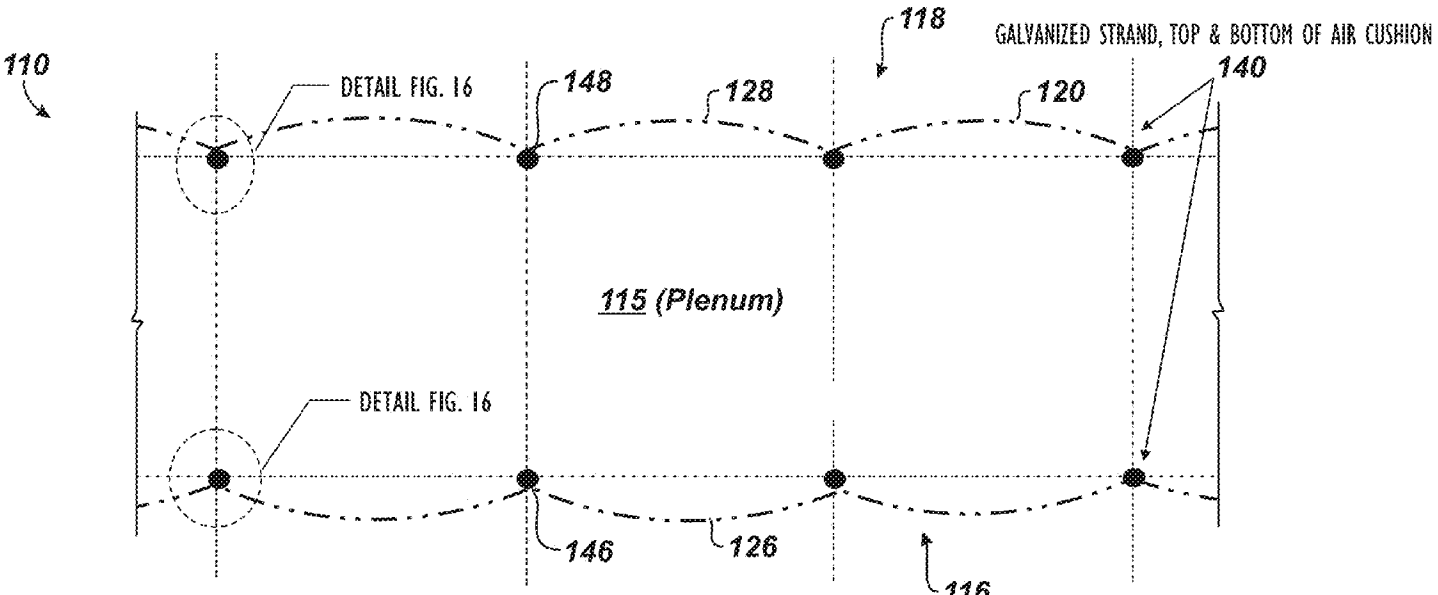
FIG. 9B is an end-to-end cross-section of the deployable roof in FIG. 9A.
Figure 9A:
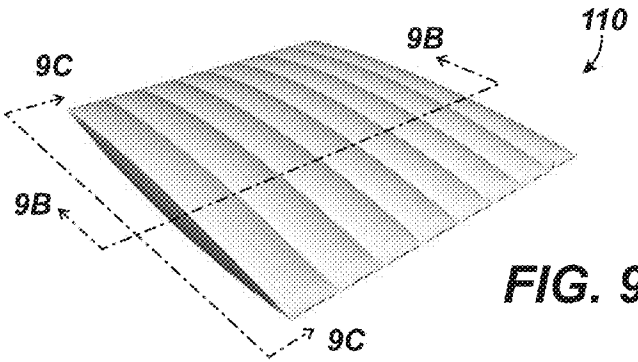
FIG. 9A is a perspective view of the deployable roof using the top and bottom lateral cables.
Figure 9C:
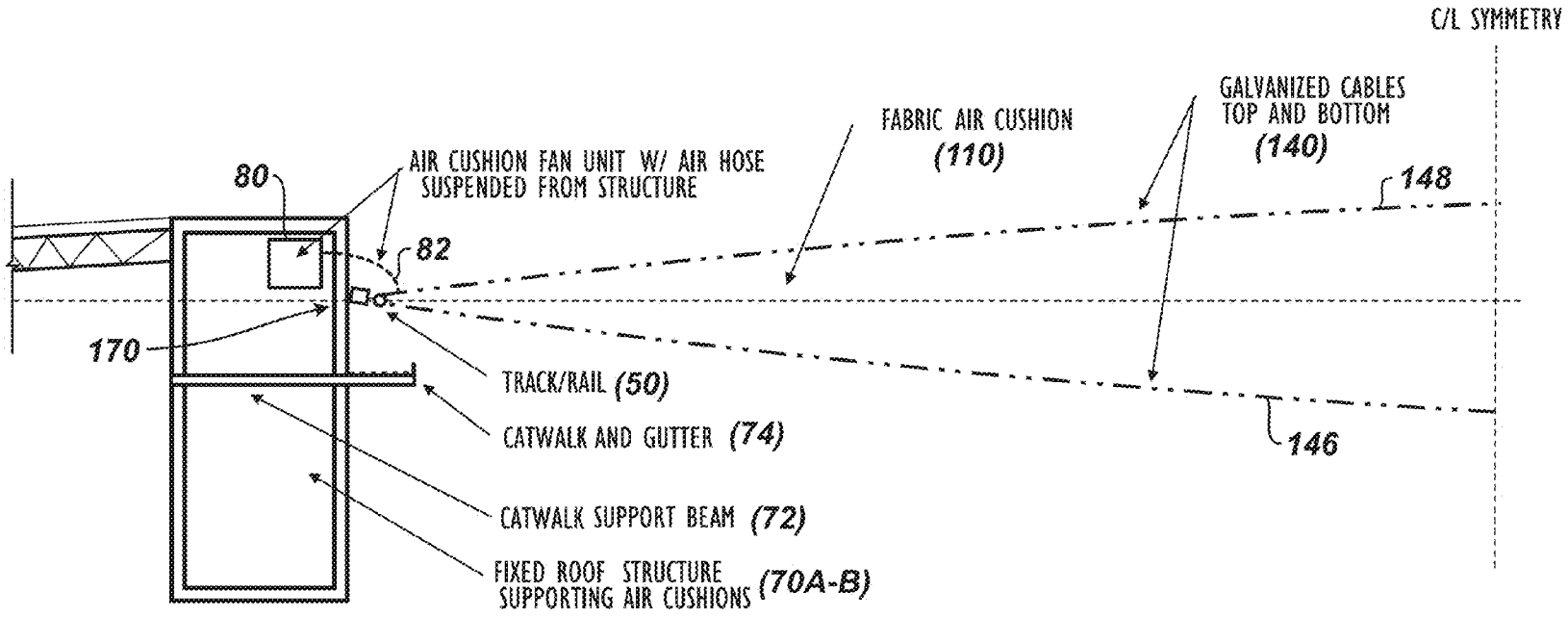
FIG. 9C is a cross-section through a portion the deployable roof in FIG. 9A, further showing features of coupling of the deployable roof to the support structure.

Turning to FIG. 9A, the deployable roof 110 has the lateral cables 140 and is shown deployed and inflated. FIG. 9B shows a cross-section through a portion of the deployable roof 110 in FIG. 9A. The cables 140 are preferably galvanized steel strands and are shown supporting the top and bottom surfaces of the roof 110 in between the panels 20. Connection of the panels 20 to the cables 140 use a system discussed below with reference to FIG. 16. FIG. 9C shows a side cross-section of the deployable roof 110 in FIG. 9A and reveals features of the coupling of the deployable roof 110 to the support structure, which has either a roof component 70A or buttresses 70B. The top and bottom cables 146 and 148 couple at their ends to a coupling 170 that can move along the rail or track system 50. In turn, the track system 50 is affixed to the fixed structure 70A or buttress 70B. A catwalk and gutter 74 can be used to access the track system 50 and components and may be supported by the structure 70A or buttress 70B with a support beam 72. A fan unit 80 shown affixed to the structure 70A or buttress 70B connects by a connecting element 82 (e.g., a hose, conduit, piping, or the like) to the edge opening between the top and bottom panels 128 and 126 on the roof 110.

As shown in FIG. 9B, the top panels 128 connect to the top cables 148 to form the top cover 118, while the bottom panels 126 connect to the bottom cables 146 to form the bottom cover 116. This leaves the plenum 115 between the covers 116 and 118 to be filled with air (from blower units 80 as described herein).

Figure 10A:
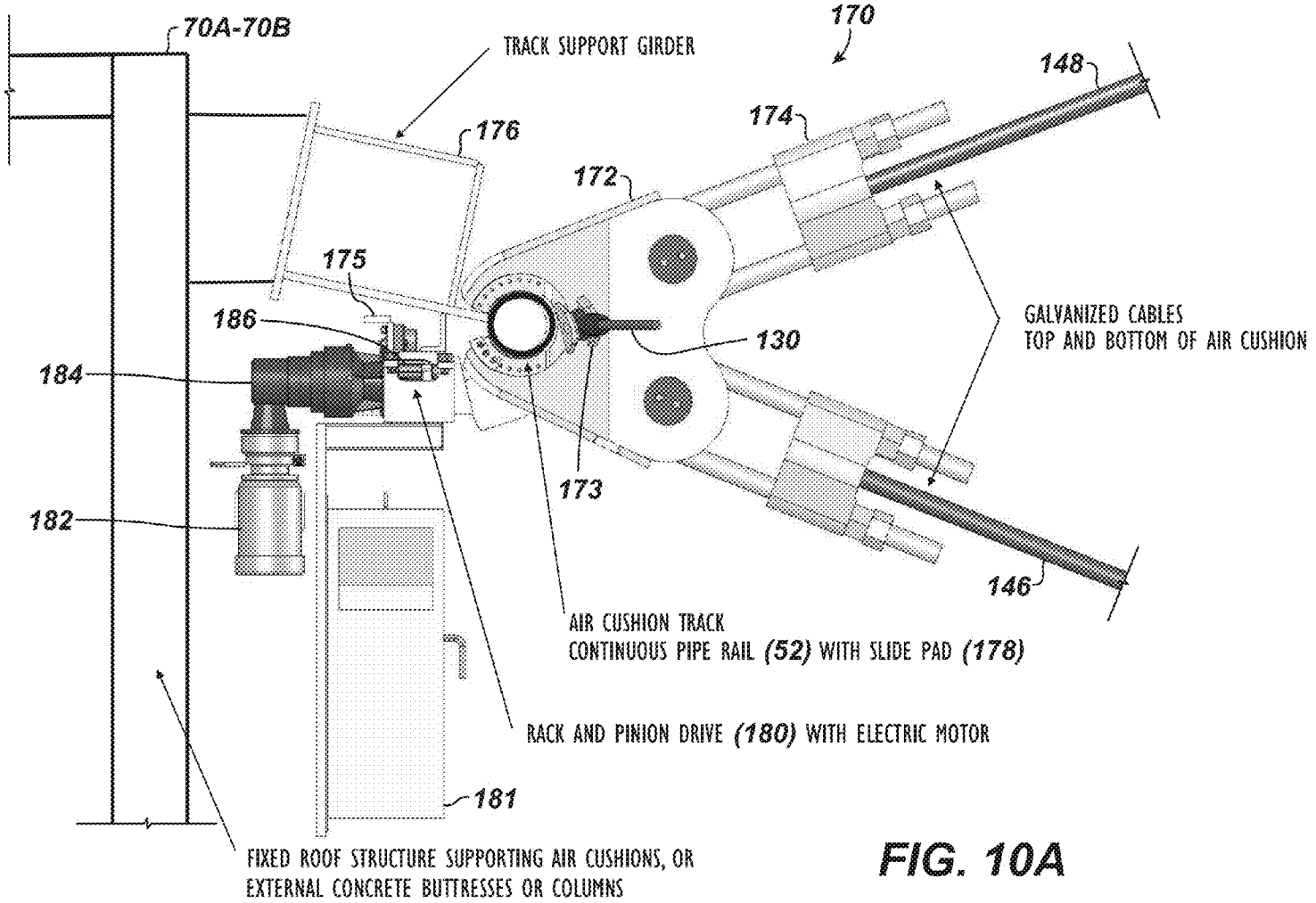
FIG. 10A is a detailed side view of one method of coupling the deployable roof of FIG. 9A to the support structure.
Figure 10B:
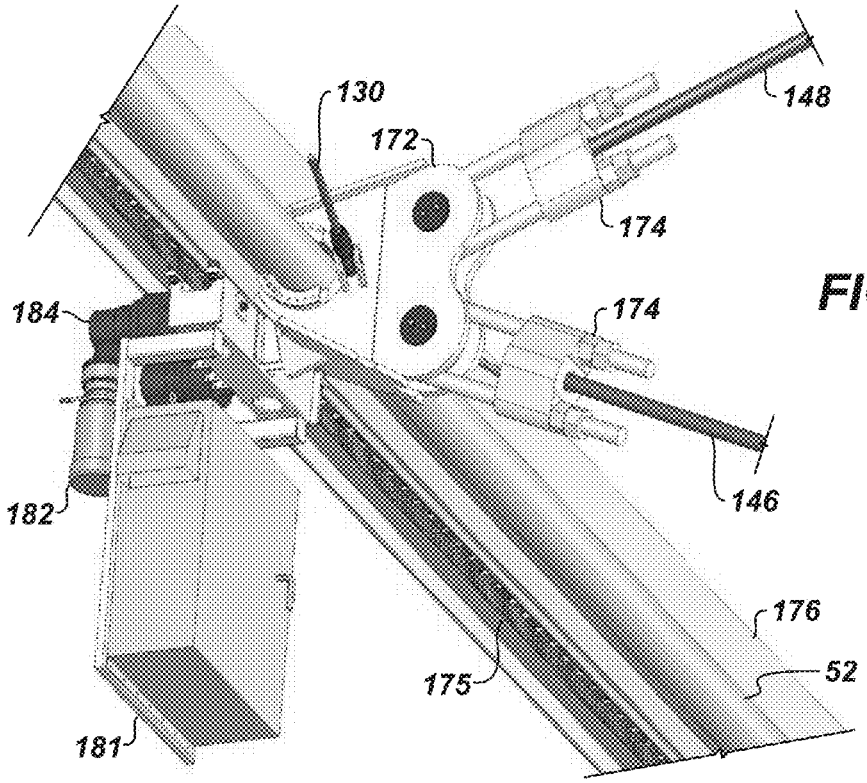
FIG. 10B is a bottom perspective view of the coupling in FIG. 10A.
Figure 10C:
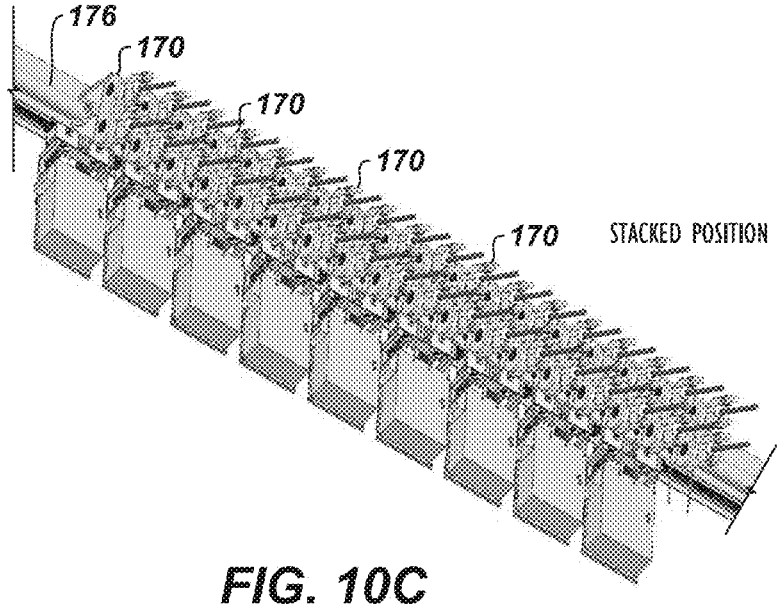
FIG. 10C is a bottom perspective view of a plurality of the couplings in FIG. 10A stacked in a retracted condition on a rail.

Further details of the coupling 170 for the roof 110 to the supporting structure are shown in FIGS. 10A-10C. As best shown in the detailed side view of FIG. 10A, the coupling 170 includes a body 172 that disposes on a continuous pipe rail 52 with a slide pad 178. The other end of the body 172 has pivotable fasteners 174 to which ends of a pair of upper and lower cables 146 and 148 connect. Side fasteners 173 are also provided for connecting to any side cables 130 used along the ends of the panels (not shown), and these fasteners 173 may also pivot on the body 172.

The continuous pipe rail 52 connects to a track support girder 176 that runs the length of the rail 52. Notably, the end of the body 172 coupling to the rail 52 is split to accommodate the connection of the rail 52 to the girder 176. Coupled to the body 172 is a rack and pinion drive 180 having an electric motor 182, gear box 184, and pinion gear 186. As best shown in FIGS. 10A-10B, the gear 186 interfaces with a rack 175 disposed along the length of the track system 50. A power unit 181 provides power and control electronics for the drive 180. As shown in FIG. 100, each pair of top and bottom cables 146 and 148 has a coupling 170 for moving along the continuous pipe rail 52. The multiple couplings 170 can stack side-by-side on the rail 52 as shown in FIG. 100 when moved to the retracted position. The panels (20) and remaining portions of the cables (40) are not shown in FIG. 100 to reveal the details of the couplings 170.

Figure 11A:
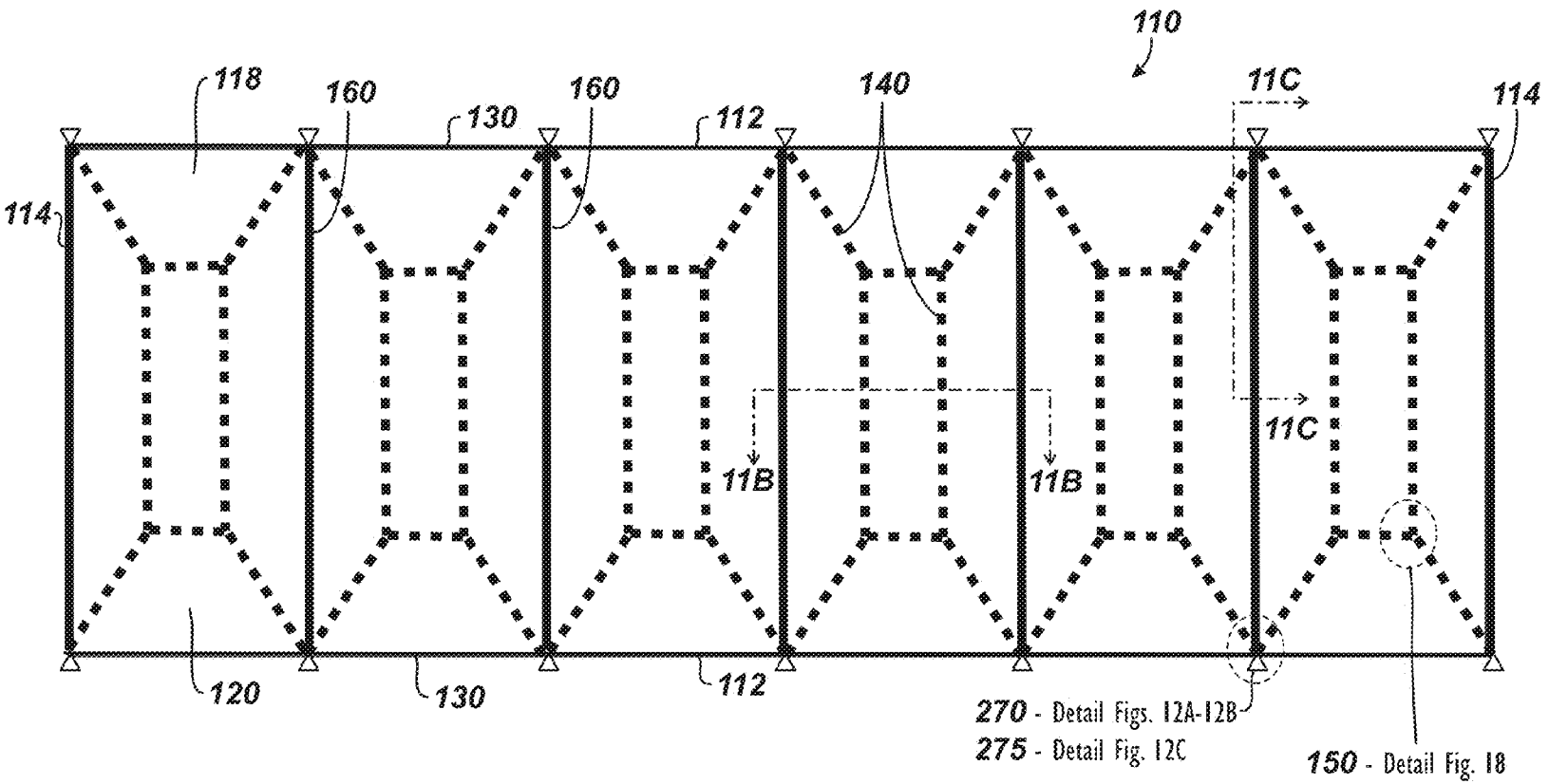
FIG. 11A is a plan view of a deployable structure having trusses and interconnecting cables.
Figure 11B:
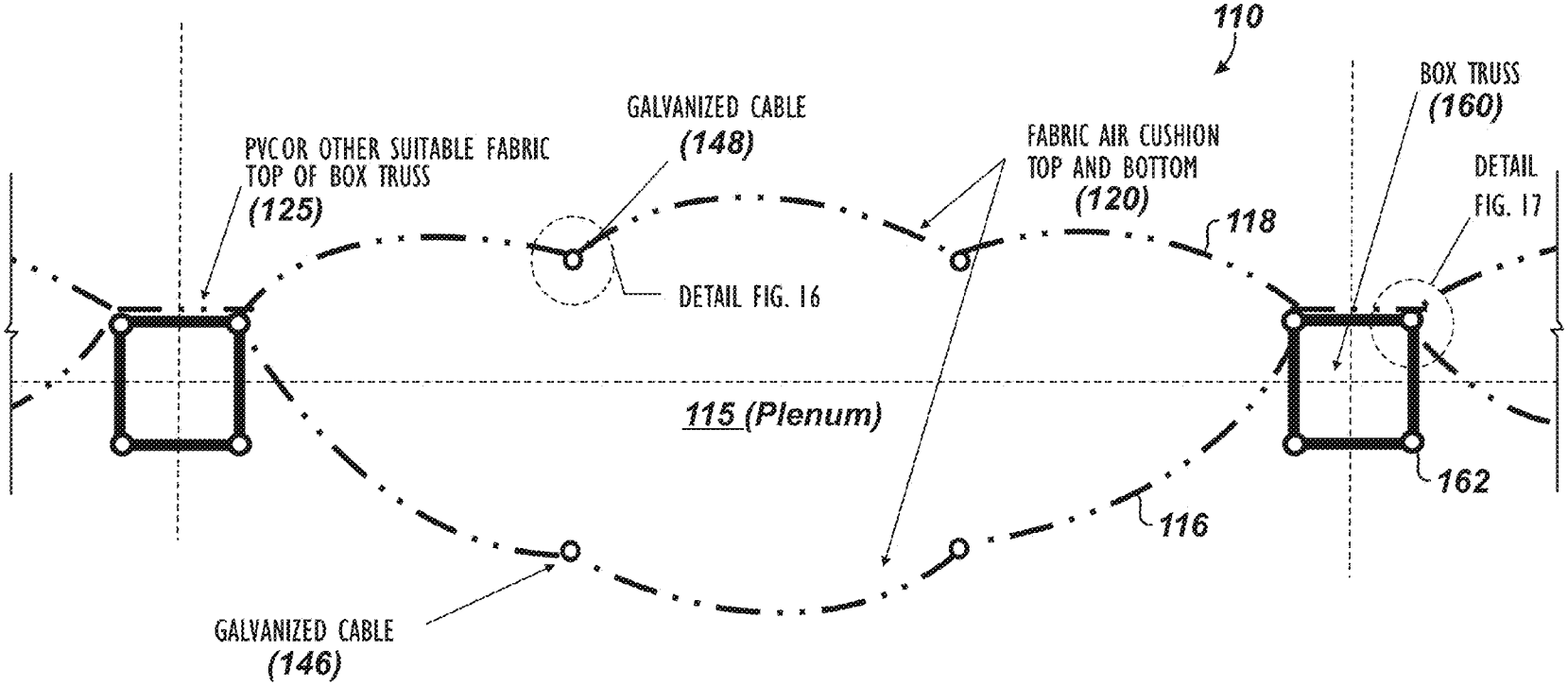
FIG. 11B is a cross-section through a portion of the deployable structure in FIG. 11A.
Figure 11C:
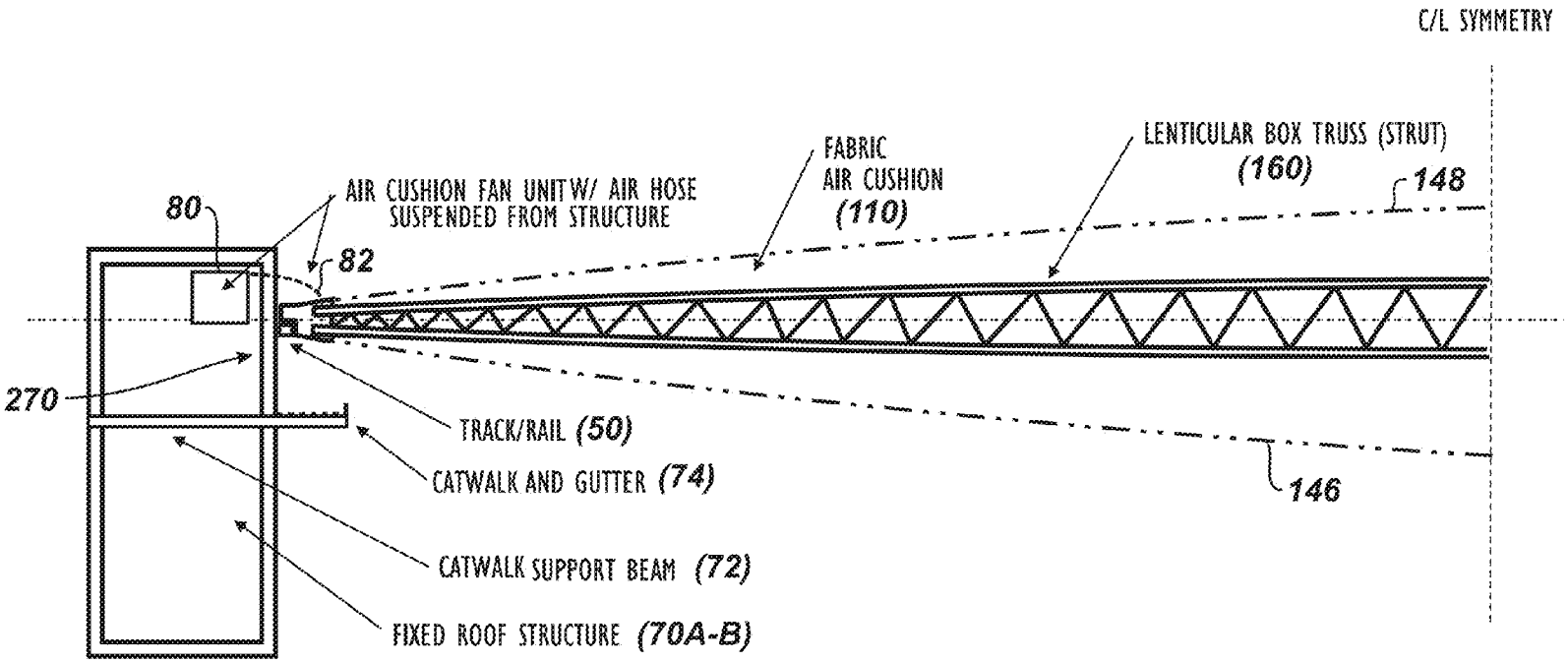
FIG. 11C is a side cross-section of the deployable structure in FIG. 11A, further showing features of coupling of the deployable structure to the support structure.

FIGS. 11A-11C show another deployable roof, wall, or other 110 that uses struts 160 similar to the structure 110 as described above with reference to FIGS. 6A-6B. The structure 110 of FIGS. 11A-11C may be particularly suited for use as a roof or wall. In the plan view of FIG. 11A, the deployable structure 110 has a plurality of struts 160 disposed between membrane panels 120. Additionally, the panels 120 further include an arrangement of interconnecting cables 140 as well as side cables 130. As shown, the panels 120 may have several separate sections, including a rectangle surrounded by four trapezoids. The panel 120 may comprise one sheet or membrane overlaying the cables 140 or may comprise several sheets or membranes (one rectangle and four trapezoids) with their edges connected to the cables 140.

Connection of the structure 110 to the track system 50 at the struts 160 uses a coupling 270 (which is discussed below in FIGS. 12A-12B). Interconnection of the cables 140 on the panel 120 uses connecting plates 150 (which is discussed below in FIG. 18). Connection of the cables 140 to the couplings 270 uses a connecting plate 275 (which is discussed below in FIG. 12C).

Before turning to these features, discussion turns to the cross-section through a portion of the deployable structure 110 as shown in FIG. 11B. A number (e.g., three) of upper panels 120 are shown interconnected between adjacent struts 160. Here, the struts 160 are shown as box trusses having a lenticular shape, but they may be composed of any similar structural member. Similarly, a number (e.g., three) of lower panels 120 are shown interconnected between the adjacent struts 160. In between the panels 120, the edges of the panels 120 affix to the interconnecting cables 140. Attachment of the panels 120 to the cables 140 is discussed below in FIG. 16. Preferably, the outlying panels 120 on both the top and bottom sides of the structure 110 connect to the top of the struts 160 so that the struts 160 remain covered. Attachment of the panels 120 to the struts 160 is discussed below in FIGS. 17A-17B.

As shown in FIG. 11B, the top panels 128 connect to the top cables 148 to form the top cover 118, while the bottom panels 126 connect to the bottom cables 146 to form the bottom cover 116. This leaves the plenum 115 between the covers 116 and 118 to be filled with air (from blower units 80 as described herein).

Figure 13A:
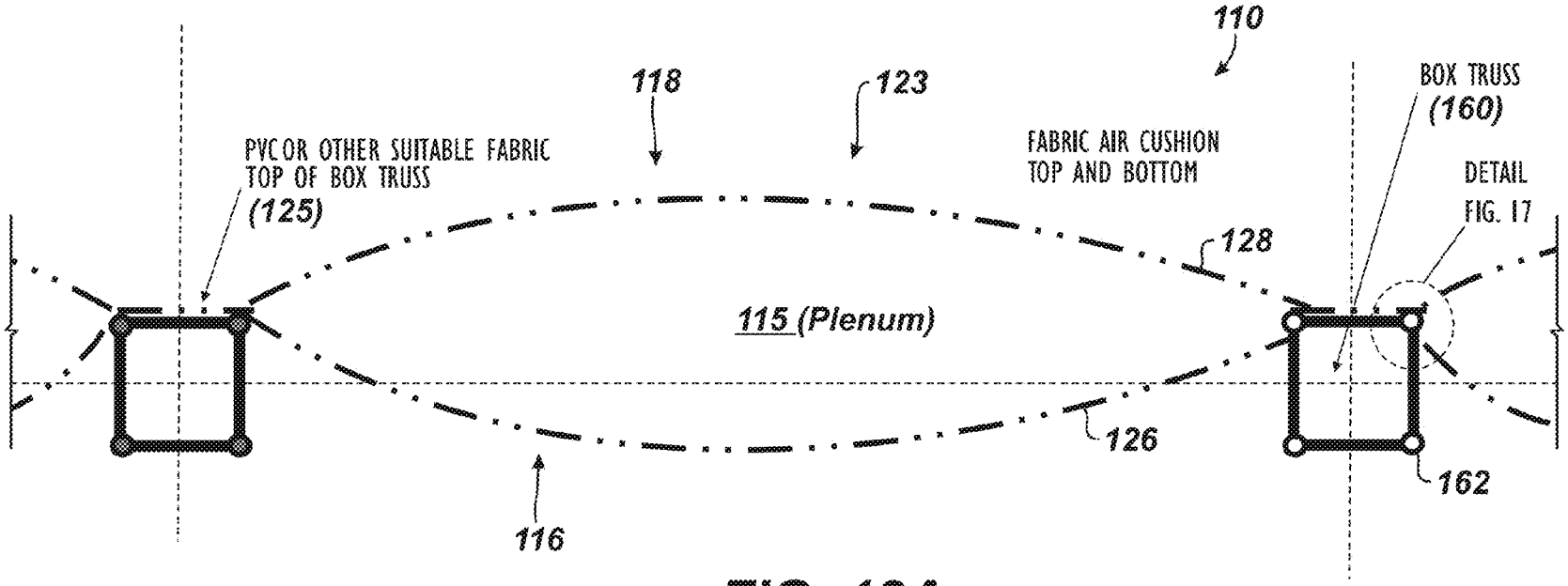
FIG. 13A is a cross-section through a portion of a deployable structure having lateral struts and independent pillow sections.
Figure 13B:
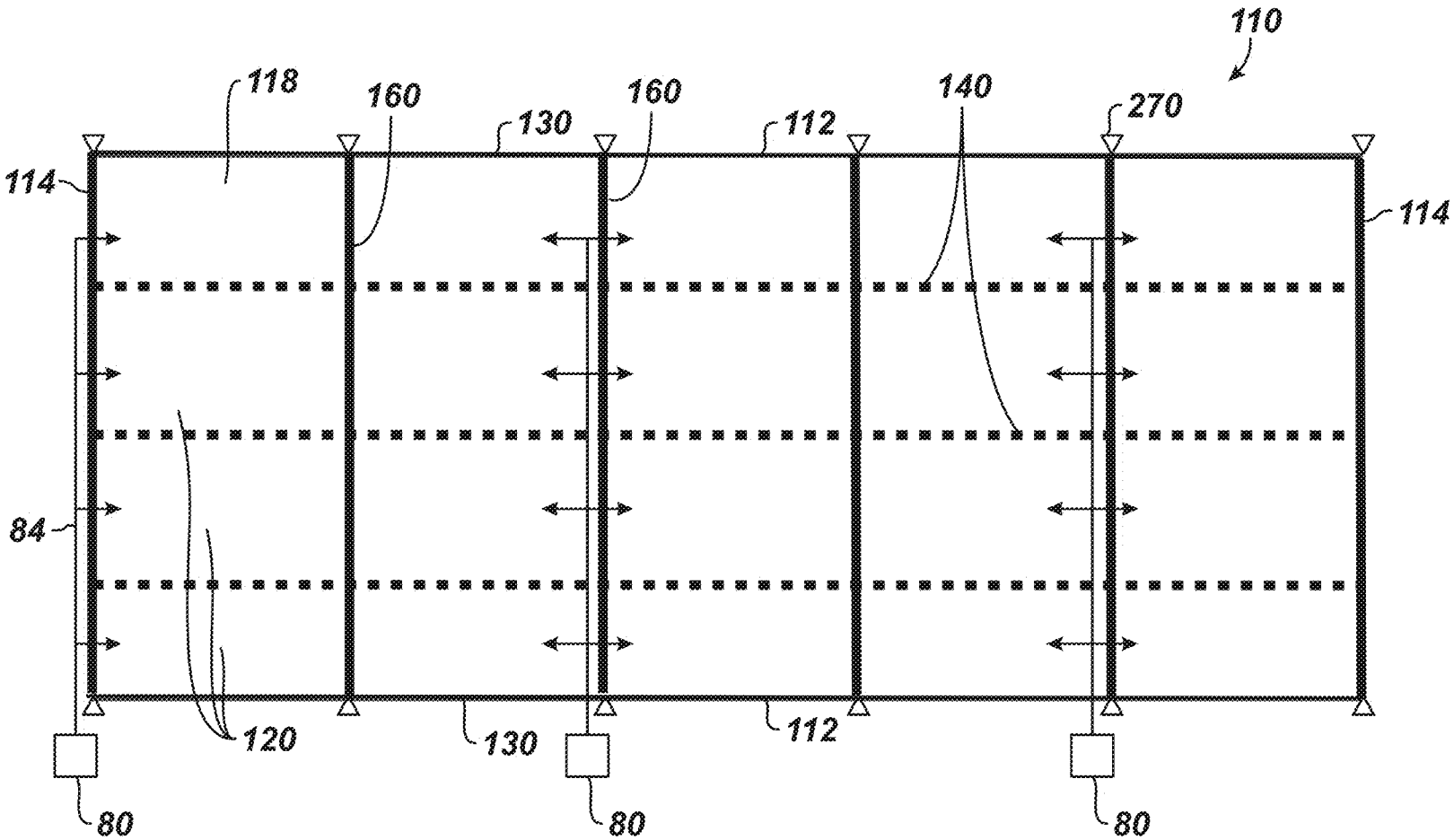
FIG. 13B is a plan view of a deployable structure having lateral struts and longitudinal panels.

Other alternative arrangements can be used as well, such as shown in FIGS. 13A and 13B. Here in FIGS. 13A and 13B, top and bottom panels 126 and 128 affix to the same struts 160 to form the top and bottom covers 116 and 118. Cables may or may not are not used in this arrangement depending on strut spacing. Each pair of panels 126 and 128 forms an independent pillow structure 123 with a plenum 115 to be filled with air (from an associated blower unit 80 as described herein).

In the side cross-section of the FIG. 11C, the connection of a strut 160 to the support structure 70C is shown. The strut 160 extends laterally across the structure 110 (only half being depicted), and a coupling 270 connects the strut 160 to a track system 50. The cables 146 and 148 can be expanded above and below the strut 160 when the structure 110 is filled with air.

The coupling 270 can move along the rail or track system 50. In turn, the track system 50 is affixed to the fixed structure 70C. A catwalk 74 and gutter can be used to access the track system 50 and other components, and the catwalk 74 may be supported to the structure 70C with a support beam 72. A fan unit 80 is shown affixed to the structure 70C connects by communication line 82, such as a hose, conduit, piping, or the like, to the edge opening between the top and bottom panels 126 and 128 on the structure 110.

Figure 11D:
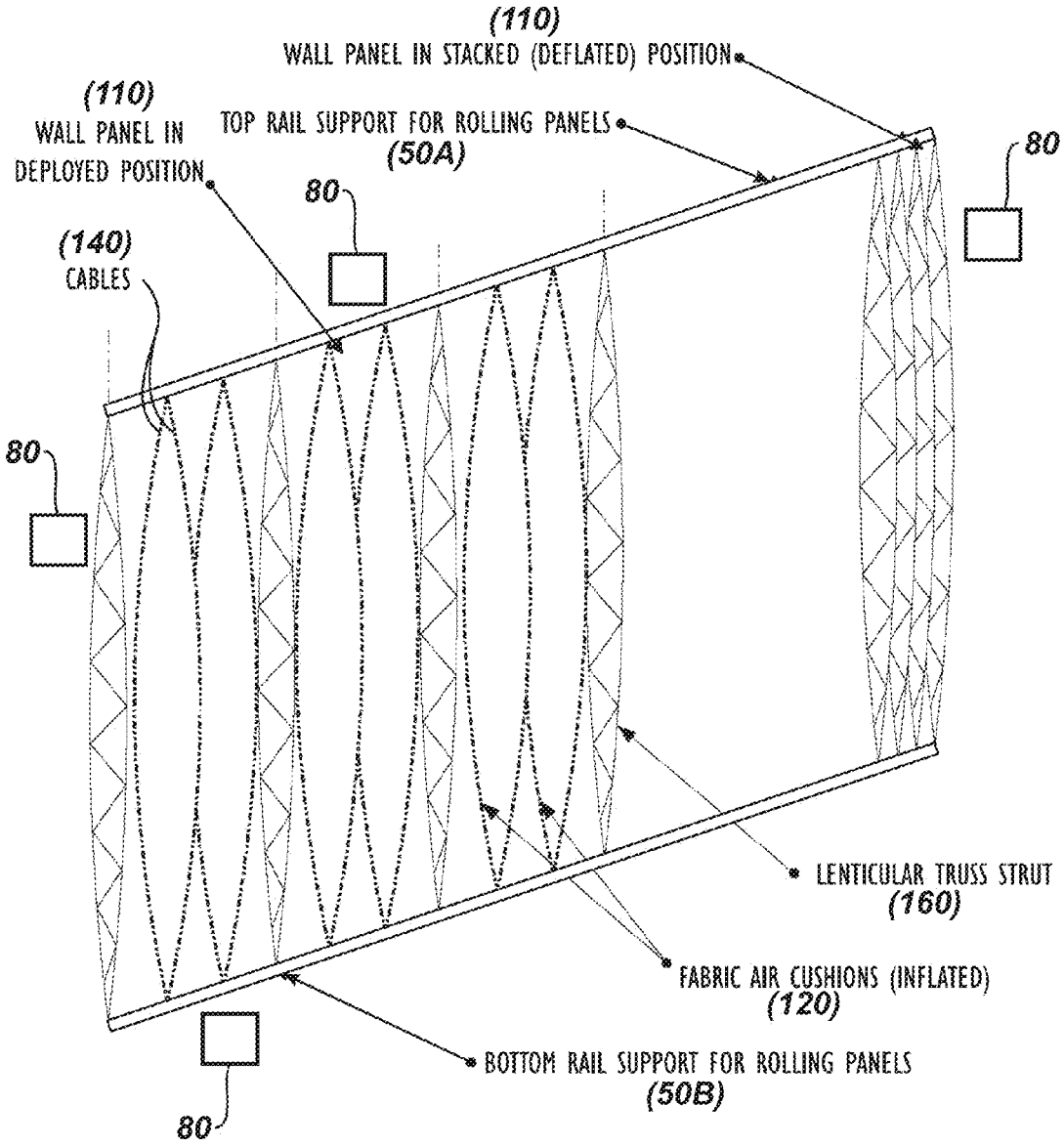
FIG. 11D is an elevational view of the disclosed structure in the form of a wall depicted in both retracted and deployed conditions.

As noted herein, the disclosed structure 110 can be used as a roof, a wall, or the like. To that point, FIG. 11D is an elevational view of the disclosed structure 110 in the form of a wall or other vertical structure depicted in both retracted and deployed conditions. The structure 110 as a wall has top and bottom rail supports 50A-50B for moving the wall 110 between a stacked and deflated position (i.e., on the right-hand side of FIG. 11D) and a deployed and inflated position (i.e., on the left-hand side of FIG. 11D). The wall 110 includes lenticular struts 160 and panels 120 as before placed substantially vertically between the top and bottom rails 50A-50B. The panels 120 may further include support cables 140 in any of the various arrangements as disclosed herein.

Blowers 80 at one or both ends and/or along the top and bottoms edges of the wall 110 can be used to inflate the wall panels 120 in the manner described herein when they are spread out along the support rails 50A-50B. Multiple sections of wall 110 can be used on the same pair of rails 50A-50B as desired. Finally, the struts 160 can be moved along the rail supports 50A-50B in any manner disclosed herein with respect to the various couplings and mechanized systems. As will be appreciated, any features of the various couplings and mechanized systems described herein that pertain to a horizontal arrangement for the structure 110 as a roof need only be adapted for a vertical arrangement for the structure 110 as a wall in order to account for the different orientation of gravity with respect to the structure 110.

Figure 12A:
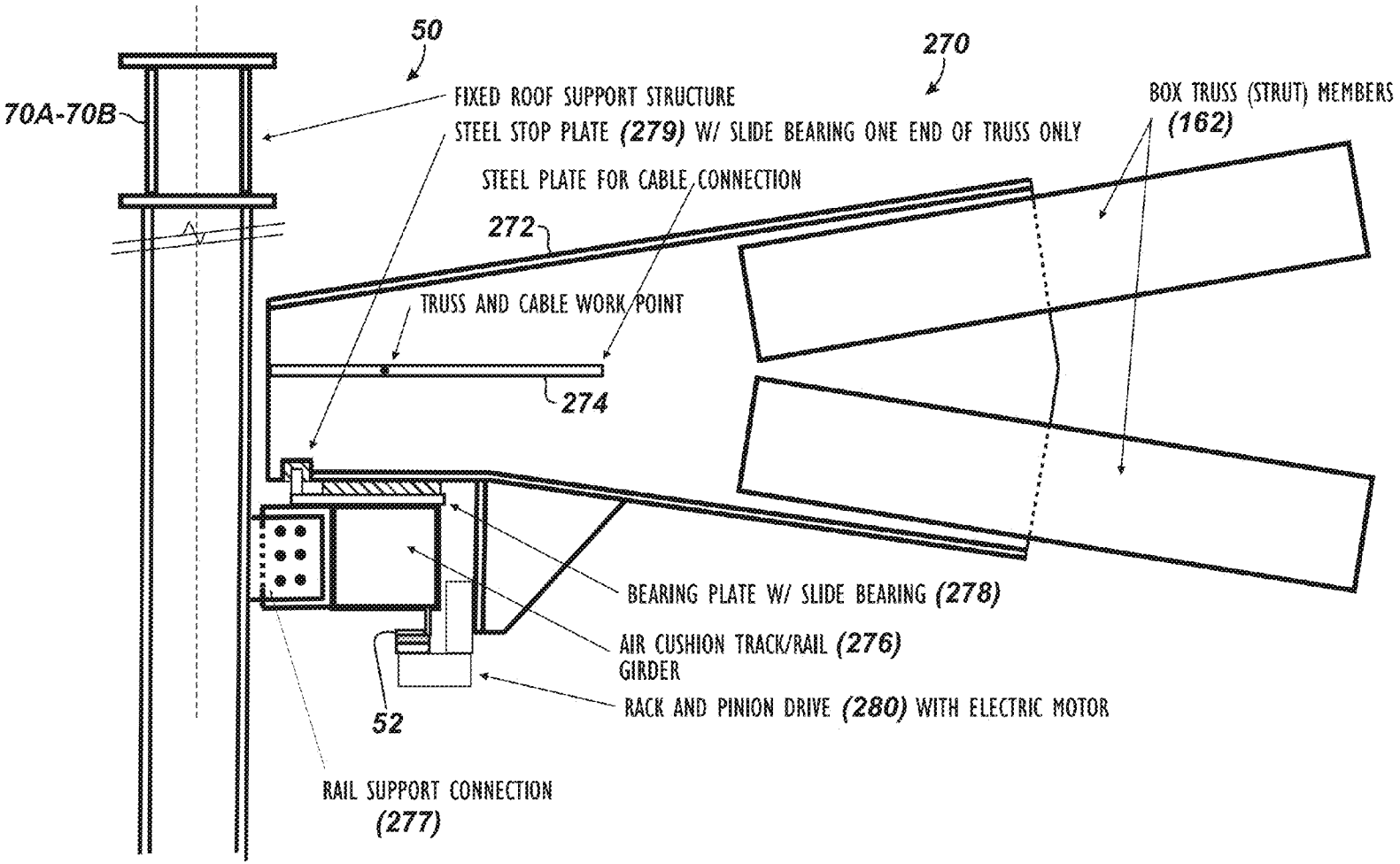
FIG. 12A is a detailed side view of one method of coupling the deployable structure of FIG. 11A to the support structure.
Figure 12B:
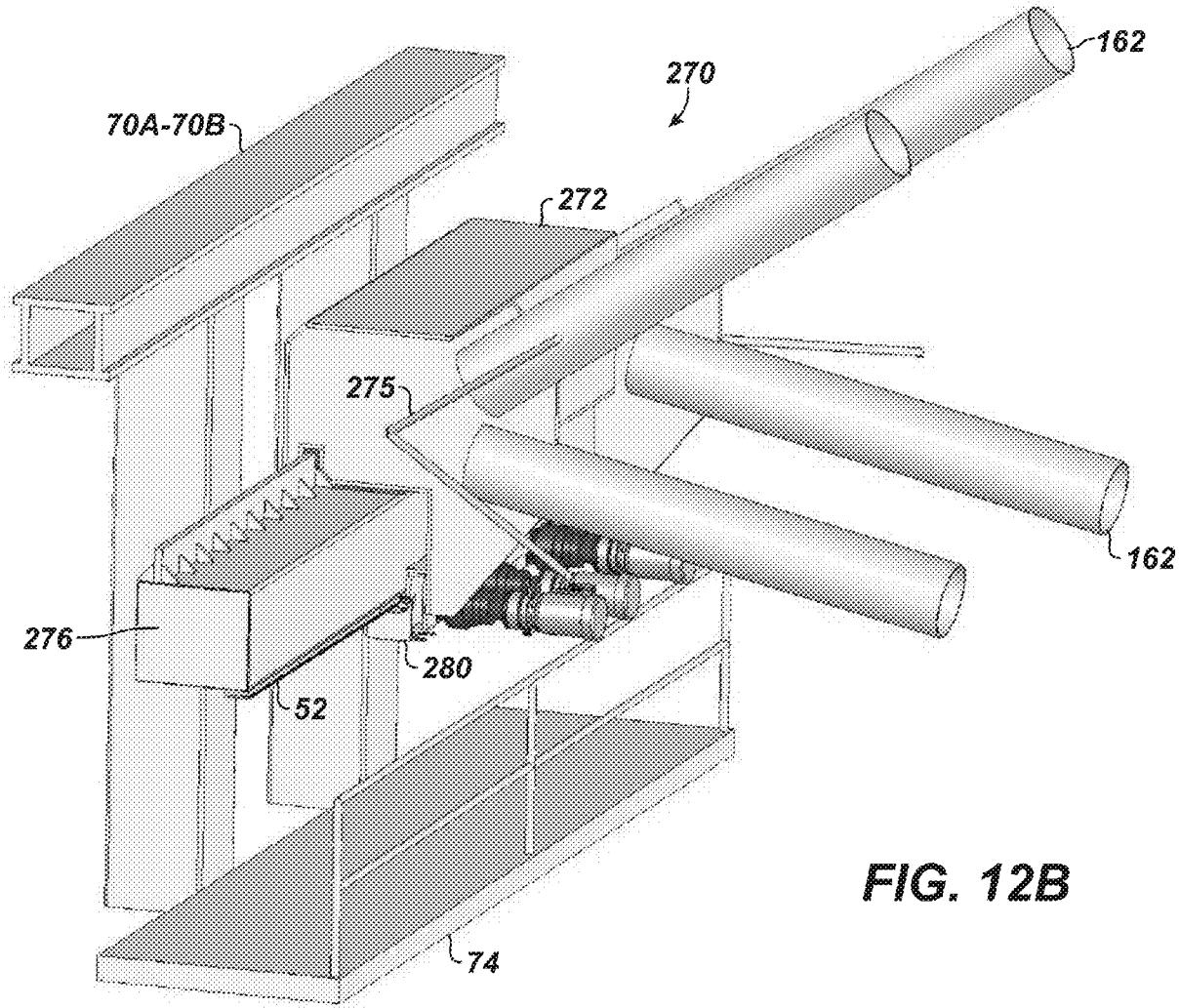
FIG. 12B is a top perspective view of the coupling in FIG. 12A.

Details of a coupling 270 for the structure 110 are shown in FIGS. 12A-12B. As best shown in the detailed side view of FIG. 12A, the coupling 270 includes a body 272 that disposes on a bearing plate 278 and girder 276 attached by a support connection 277 to the support structure 70C. The other end of the body 172 has receptacles to which the truss (strut) members 162 of the strut 160 affix. A plate 274 for a cable connector (described below in FIG. 12C) is disposed on each side of the coupling body 272.

A track 52 is disposed below the girder 276 and runs along its length, and a rack and pinion drive 280 with an electric motor 282 and other components connect to the coupling body 272 and interface with the track 52 to move the coupling 270 along the girder 276. A power unit (not shown) can provide power and control electronics for the drive 280. The panels (120) and remaining portions of the cables (140) are not shown in FIGS. 12A-12C.

Figure 12C:
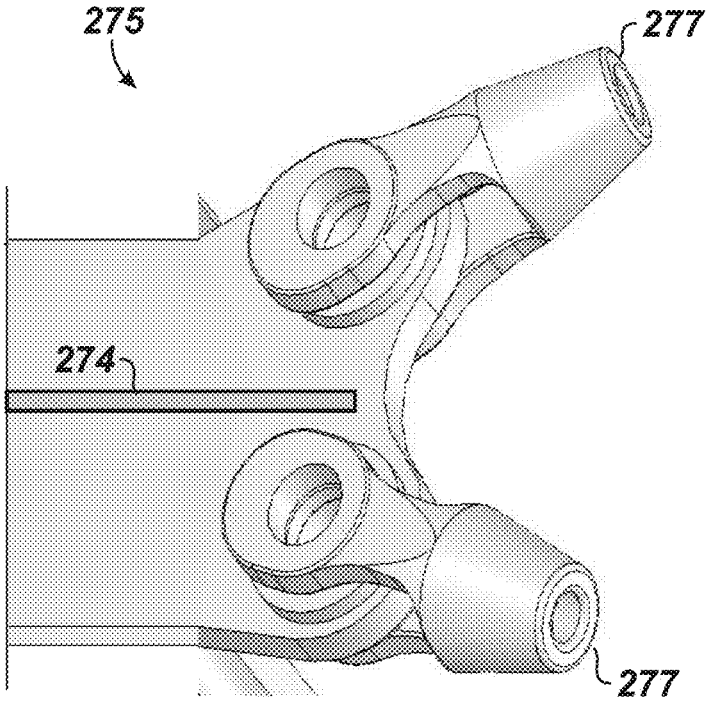
FIG. 12C is a side view of a cable end fitting for the coupling in FIG. 12A.

FIG. 12C shows a cable connector 275 which affixes to the plate (274: FIG. 12A) on both sides of the coupling (270: FIG. 12A). The cable connector 275 has pivotable connections 277, one for each top and bottom cables (not shown).

As discussed above in FIGS. 11A-11C, the deployable structure 110 uses lateral struts 160 disposed between membrane panels 120 that essentially run laterally similar to the struts 160. In an alternative arrangement shown in a plan view in FIG. 13B, the structure 110 can have lateral struts 160 as before, but panels 120 can run longitudinally between the struts 160. These panels 120 may further include cables 140 similar to other arrangements. Each panel 120 can form its own pillow structure with upper and lower panels (not shown) connected to the cables 140 similar to other embodiments disclosed herein. Alternatively, all of the panels 120 (both upper and lower) between adjacent struts 160 can share the same plenum similar to the arrangement of FIG. 9B.

To inflate the panels 120, blower units 80 as shown in FIG. 13B arranged along the longitudinal sides of the structure 110 can connect with piping 84, which can be integrated into the struts 160. Air from the blower units 80 communicated through the piping 84 can then be distributed to the various longitudinally arranged panels 120 to inflate the structure 110.

Figure 14A:
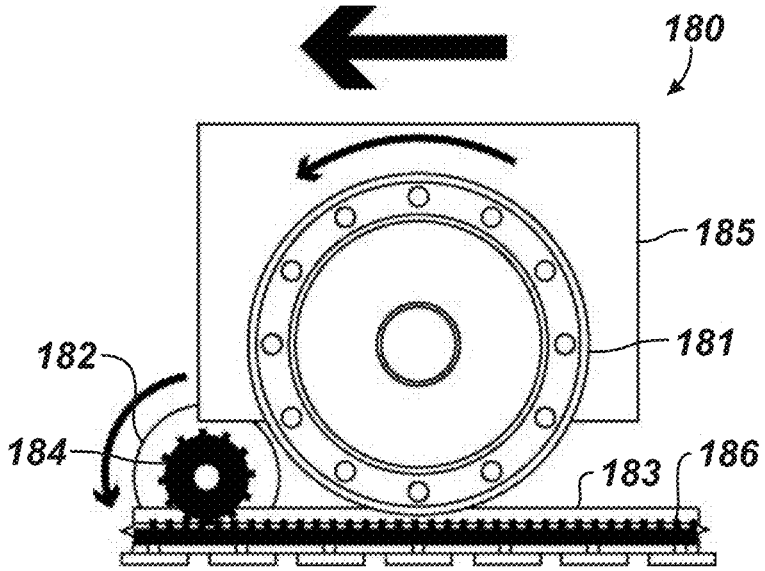
FIG. 14A shows a rack and pinion mechanism for use in moving the couplings of the deployable structure on a rail.
Figure 14B:
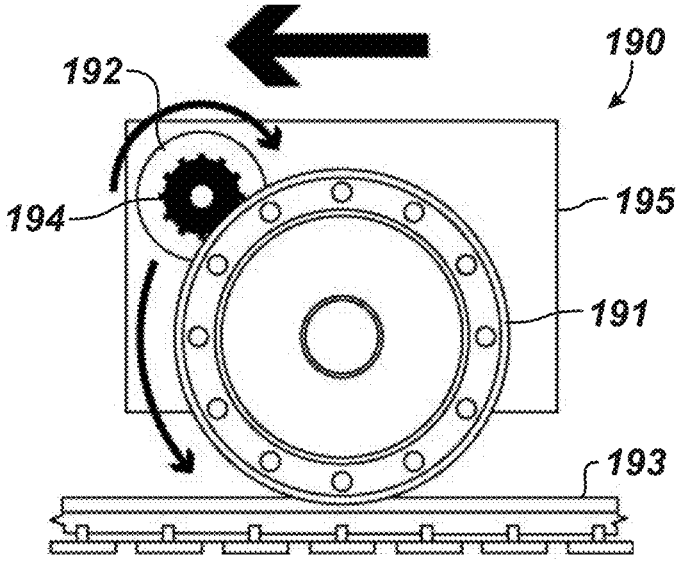
FIG. 14B shows a pinion and bull gear mechanism for use in moving the couplings of the deployable structure on a rail.
Figure 15B:
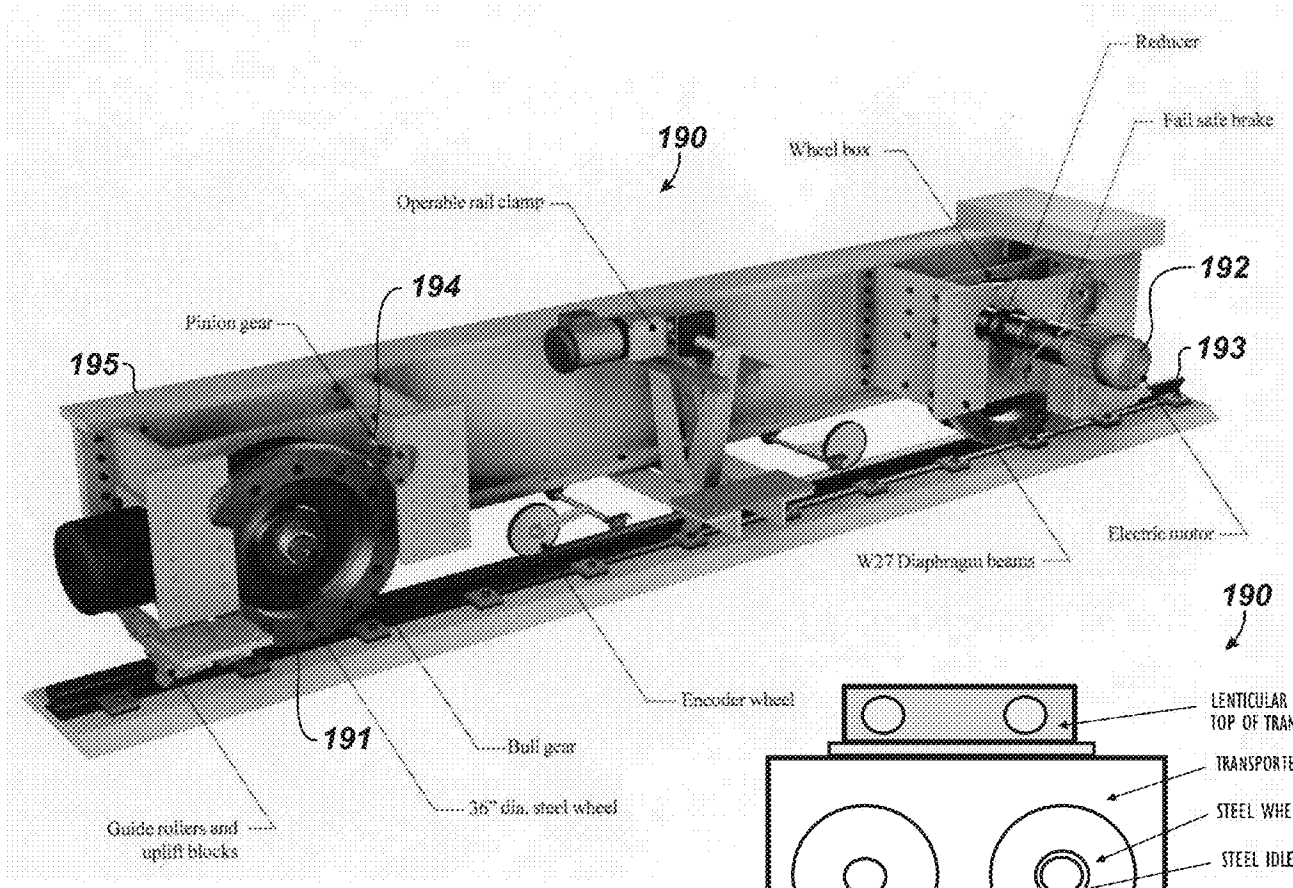

As discussed above, a mechanized system moves the roof, wall, or other structure 110 disclosed herein along tracks or rails. In general, the mechanized system can utilize a rack and pinion drive system (FIG. 14A), a traction drive system (FIG. 14B), or a cable drive system (FIGS. 15C-1 and 15C-2). In particular, FIG. 14A shows a rack and pinion mechanism 180 for use in moving the couplings of the deployable structure 110 on a rail 183, and FIG. 14B shows a pinion and bull gear mechanism 190 for use in moving the couplings of the deployable roof on a rail 193. Both of these systems 180 and 190 can use small electric motors 182 and 192 to power moving a transporter beam or bogy 185 and 195 to which the roof's couplings (not shown) attach.

In the rack and pinion drive system 180 of FIG. 14A, the bogy 185 and attached roof coupling (not shown) ride on a track 183 with one or more wheels 181. To move the bogy 185, a machined steel rack 186 is attached along the track 183, and an electric motor 182 powers a pinion gear 184 along the rack 186. In the traction drive system 190 of FIG. 14B, the bogy 195 and attached roof coupling (not shown) also ride on a track 193 with one or more wheels 191. To move the bogy 195, the wheel 191 has a bull gear mating with a gear 194, and an electric motor 182 powers the pinion gear 184 to rotate the wheel 191 and move it along the rail 193. The choice of which mechanized system 180 or 190, or any other system, to use is based on roof slope (e.g., traction drive systems 190 are limited to flat or low slope tracks 193) and overall economy of the design.

Figure 15A:
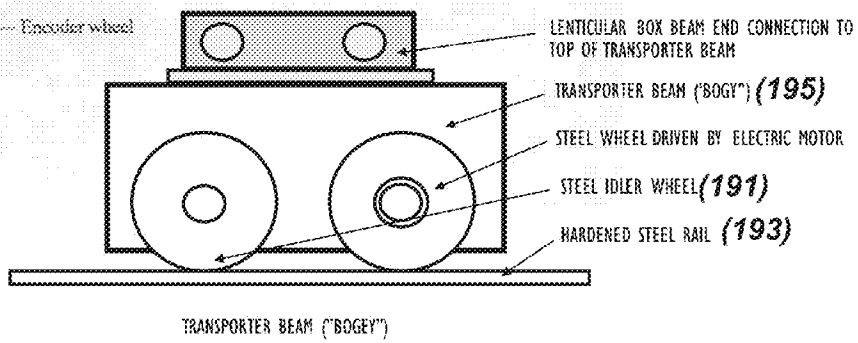
Figures 1, 15C:
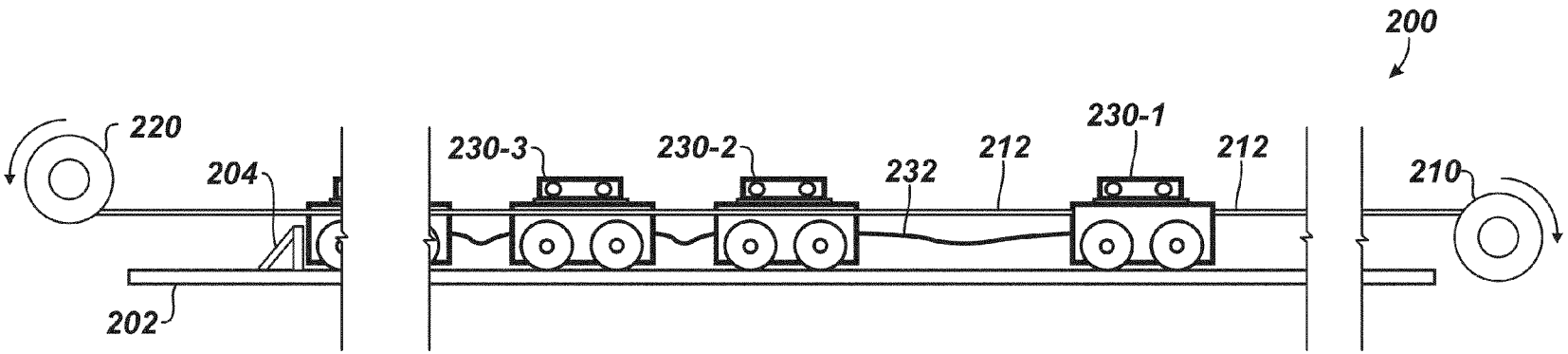
FIGS. 15C-1 and 15C-2 show a cable drive system for use in deploying and retracting the deployable structure.
Figures 2, 15C:
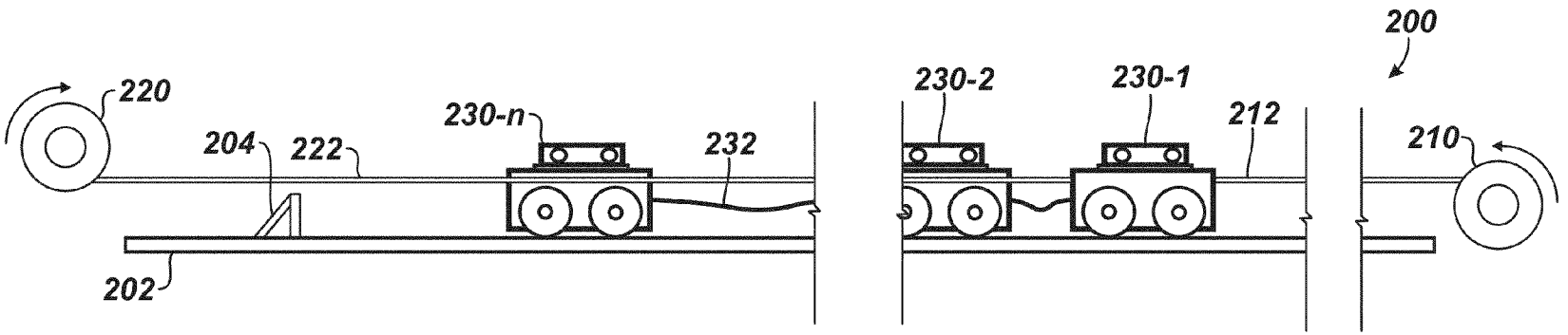

FIGS. 15A-5B show examples of traction drive systems 190 for moving the deployable structure (110) on a rail 193. As shown in FIG. 15A, for example, the bogy 195 has a lenticular beam end connection for connecting to a strut (not shown). A steel wheel 191 is driven by an electric motor (not shown). This wheel 191 along with an idler wheel 191 ride along a hardened steel rail 193. As shown in FIG. 15B, the bogy 195 can having additional components, including, for example, a reducer for the electric motor, a failsafe brake, a wheel box, guide rollers on uplift blocks, encoder wheels, and rail clamp as labeled. These and other components can be used on the traction drive systems 190 as shown and on the rack and pinion drive system 180 of FIG. 14A.

As noted briefly above, cable drive systems can be used to deploy and retract the disclosed structure. For example, FIGS. 15C-1 and 15C-2 schematically show one example of a cable drive system 200 that can be used to deploy and retract the disclosed structure. Although one example is shown, it will be appreciated with the benefit of the present disclosure that a number of different types of cable drive systems could be used.

As shown for only one side of the disclosed structure, the system 200 includes a rail 202 on which wheeled bogies 230 can travel. (The opposing side of the structure may have a comparable system 200). The bogies 230 can be similar to those discussed previously so that they can include wheels for riding on the rail 202 and can support a lenticular box beam or other end connection as the case may be. Winches 210 and 220 having drums and electric motors oppose one another at the ends of the rail 202 and connect by cables 212 and 222 to a lead bogy 230-1.

An intermediate cable 232 connects the lead bogy 230-1 to the next following bogy 230-2, and additional intermediate cables 232 interconnect the following bogies 230-2 . . . **230-*n* together. These cables 232 can extend to a fixed length when the bogies 230 are separated from one another along the length of the rail 202. Additionally, the intermediate cables 232 can be retracted around biased pulleys or drums inside the bogies 230 when adjacent bogies 230 are moved next to one another. In this way, any excess slack in the cables 232** can be taken up when the structure is retracted.

As shown in FIG. 15C-1, deploying the structure involves operating the deployment winch 210 at the far-end of the rail 202 to wind up the lead cable 212. This pulls the lead bogy 230-1 along the rail 202 towards the far-end. Meanwhile, the retraction winch 220 unwinds its cable 222 during this process to provide slack. As the lead bogy 230-1 moves, it begins to pull away from the next following bogy 230-2, allowing the intermediate cable 232 between them to extend. Once the intermediate cable 232 reaches its full extent, the next body 230-3 begins to move along the rail 202, being pulled by the deployment winch 210 and train of bogies 230. This process repeats down the length of the structure until the structure deploys across the edifice's opening as disclosed herein. Although not shown, the various bogies 230 may have brake or locking systems to fix in place on the rail 202 once the structure is fully deployed.

As shown in FIG. 15C-2, retracting the structure involves operating the retraction winch 220 to wind up the retraction cable 222, which pulls the lead bogy 230-1 along the rail 202 towards the near-end. Meanwhile, the deployment winch 210 unwinds its cable 212 during this process. As the lead bogy 230-1 moves, it begins to move toward the next following bogy 230-2, allowing the intermediate cable 232 between them to retract internally to take up slack. Once the bogies 230-1 and 230-2 come together, they move together to the next body 230-3. This process repeats down the length of the structure until the structure retracts from the edifice's opening as disclosed herein. Eventually, the tail bogey **230-*n* engages a rail stop 204 on the rail 202 when all of the bogies 230** have been moved out of the way of the edifice's opening.

Figure 16:
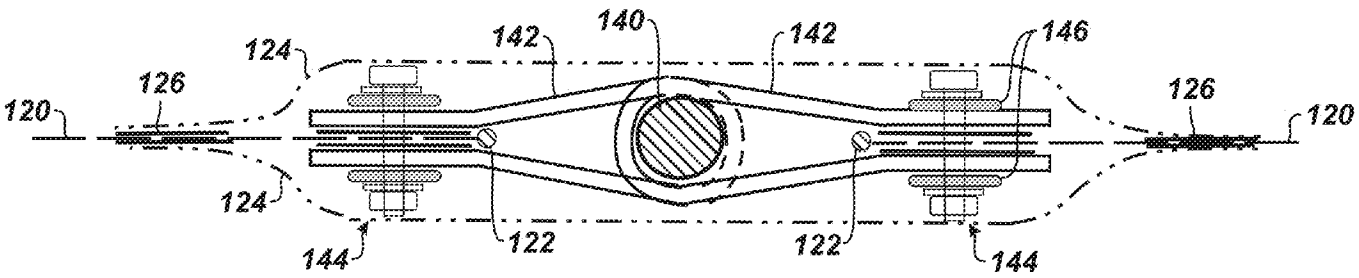
FIG. 16 is a side view of a fastener method to attach sheeting to cables on the deployable structure.

FIG. 16 is a side view of a fastener to couple panels 120 to cables on the deployable structure disclosed herein. The edges of the panels 120 have roped ends 122 disposed thereon. These edges are held between clamping elements 144, including stainless steel bolt, nut, washers, and lock washers with gaskets. Aluminum clamp bars 146 are used with neoprene gaskets and flat head socket steel cap screws. These clamping elements 144 connect to stainless steel straps 142 that fit on and around the cable 140. This construction is done on both sides of the cable 140. Upper and lower fabric covers 124 cover the top and bottom of the cable 140, straps 142, and clamping elements 144. These covers 124 are heat sealed 126 with the edges of the panels 120 to sealably cover all of the connecting components.

Figure 17B:
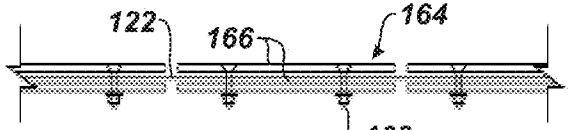
FIG. 17B is a sectional view of the fastener method of FIG. 17A.
Figure 17A:
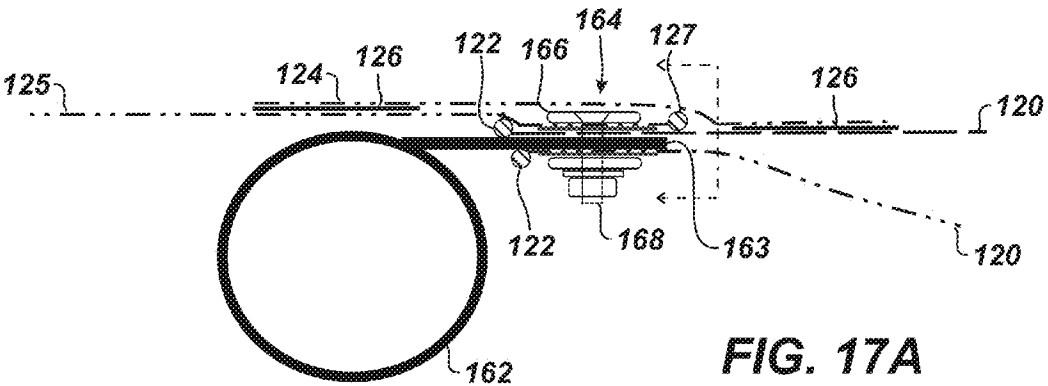
FIG. 17A is a side view of a fastener method to attach sheeting to a chord of a truss on the deployable structure in FIG. 11A.

FIG. 17A is a side view of a fastener to couple panels 120 to a beam 162 of a strut (160) on the deployable roof, wall, or other structure 110 in FIG. 11A. As shown, the panels 120 (both top and bottom) connect to the upper corner chord 162 of a box truss (160) and have roped edges 122. Clamps 164 having aluminum clamp bars 166 with a neoprene gasket and flat head socket cap screws 168 affix the edges 122 to a continuous steel plate 163 welded along the length of the struts' corner member 162. To cover the strut 160, a fabric cover 125 has a roped edge 127 that is also clamped by the clamps 164. To cover these connections, another fabric cover 124 passes over the top of the clamp 164 and has its edges sealed 126 along its length to the upper panel 120 and the strut cover 125. FIG. 17B is a sectional view of FIG. 17A, showing how the clamps 164 run the length of the strut member.

Figure 18:
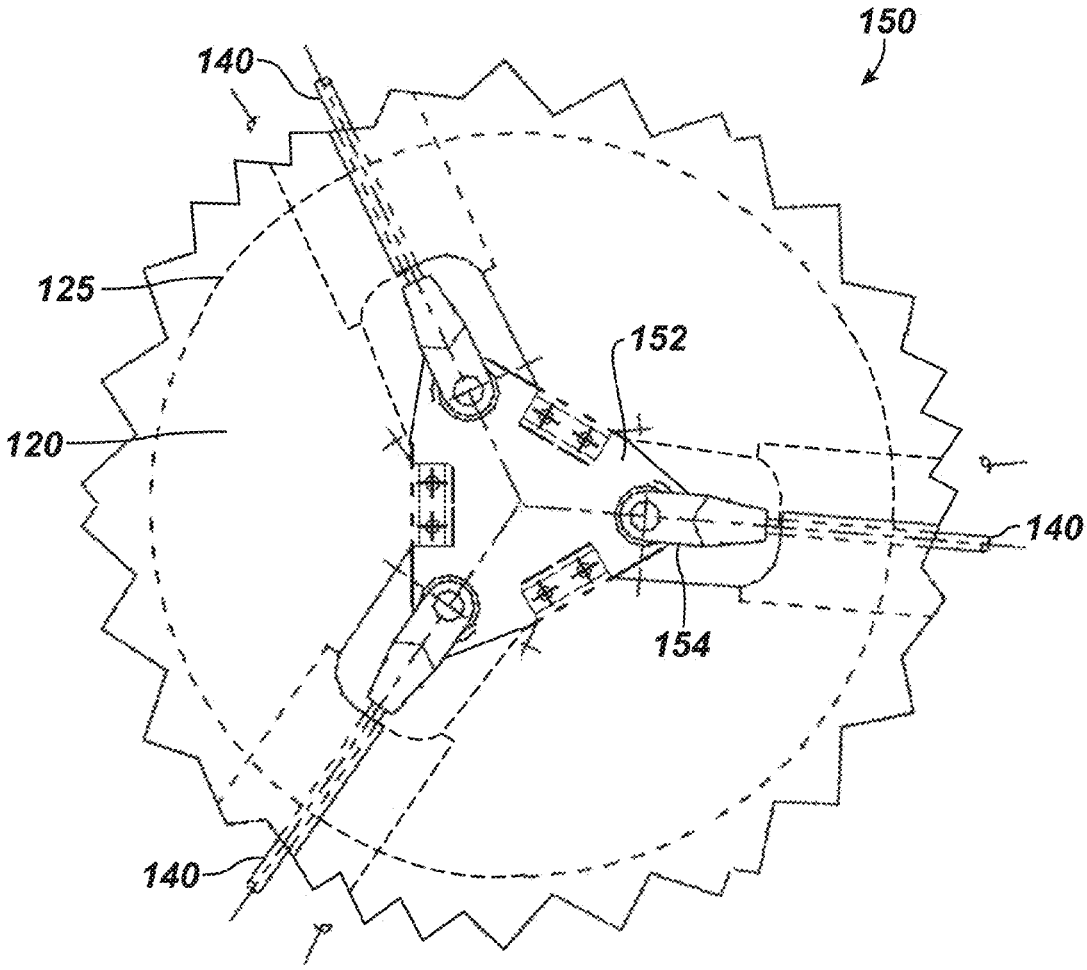
FIG. 18 is a plan view of an attachment between three cables on the deployable structure in FIG. 11A.

To connect the interconnecting cables, a cable-to-cable Y connector 150 as shown in FIG. 18 has a plate 152 with three pivotable arms 154. Each arm 154 connects to one the three interconnecting cables 140 at a juncture. The panel 120 can lie over the connector 150 to protect it from exposure. Additionally, cover sheeting 125 can be sealed to the panel 120 and can be used to enclose and cover the connector 150 to protect it from environmental exposure.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A structure to cover an exposed area of a facility, the structure comprising:

a flexible first cover;

a flexible second cover disposed adjacent the flexible first cover;

longitudinal rails disposed along edges of the flexible first and second covers;

a plurality of lateral supports extending across the flexible first and second covers from edge to edge; and couplings disposed along the edges of the flexible first and second covers and connected to the lateral supports, the couplings adapted to ride along the rails, wherein the flexible first and second covers, the couplings, and the lateral supports are adapted to retract in a folded condition away from the exposed area of the facility and to extend in an unfolded condition over the exposed area of the facility, and wherein the flexible first and second covers define at least one plenum adapted to inflate the flexible first and second covers relative to one another.

2. The structure of claim 1, wherein the structure deploys as a roof to cover the exposed area of the facility, and wherein the flexible second cover is a bottom cover disposed beneath a flexible top cover as the flexible first cover.

3. The structure of claim 1, wherein the flexible first and second covers comprises a plurality of flexible panels arranged laterally from edge to edge.

4. The structure of claim 3, wherein the lateral supports comprise first and second cables affixed respectively to the flexible panels of the flexible first and second covers.

5. The structure of claim 4, wherein the first and second covers are arranged as top and bottom covers, wherein the first and second cables are arranged as top and bottom cables, and wherein the bottom cables have a greater length than the top cables.

6. The structure of claim 1, wherein the lateral supports comprise first and second cables affixed to the couplings and affixed respectively to the flexible first and second covers.

7. The structure of claim 6, wherein the lateral supports further comprise struts disposed between the couplings at the edges of the flexible first and second covers.

8. The structure of claim 1, wherein the lateral supports comprise struts disposed between the couplings at the edges of the flexible first and second covers.

9. The structure of claim 8, wherein the flexible first and second covers comprise a plurality of flexible panels disposed laterally between adjacent ones of the lateral struts.

10. The structure of claim 8, wherein the flexible first and second covers comprise a plurality of flexible panels disposed longitudinally between adjacent ones of the lateral struts.

11. The structure of claim 1, further comprising a plurality of blowers disposed along at least one of the edges of the flexible first and second covers and adapted to blow air in the at least one plenum between the flexible first and second covers.

12. The structure of claim 1, wherein the flexible first cover comprises first longitudinal supports disposed along the edges of the flexible first cover, and wherein the flexible second cover comprises second longitudinal supports disposed along the edges of the flexible second cover.

13. The structure of claim 12, wherein the first and second longitudinal supports connect to the couplings.

14. The structure of claim 12, wherein the first and second longitudinal supports comprises cables connected to the couplings.

15. The structure of claim 1, further comprising at least one drive adapted to drive the couplings to ride along the rails.

16. The structure of claim 15, wherein the at least one drive comprises drives disposed at at least two of the couplings, the drives adapted to drive the at least two couplings to ride along the rails.

17. The structure of claim 16, wherein the drives each comprise a motor disposed on the coupling and having a pinion gear, the pinion gear interfacing with a rack disposed adjacent the rail.

18. The structure of claim 16, wherein the drives each comprise a traction drive system using an electric motor.

19. The structure of claim 16, wherein the drives each comprise a cable drive system using an electric motor.

20. A method of covering and uncovering an exposed area of a facility, the method comprising:

uncovering the exposed area by— deflating first and second covers of a flexible structure, and stacking the first and second covers of the flexible structure in a folded condition relative to the exposed area by running the first and second covers along longitudinal rails; and covering the exposed area by— spreading the first and second covers over the exposed area in an unfolded condition by running the first and second covers from the retracted condition along the longitudinal rails, and inflating the first and second covers of the flexible structure;

wherein running the first and second covers comprises driving couplings on edges of the first and second covers along the longitudinal rails between the folded and unfolded conditions.

21. The method of claim 20, comprising deploying the flexible structure as a roof to uncover and cover the exposed area of the facility.

22. The method of claim 20, wherein stacking the first and second covers of the flexible structure in the folded condition relative to the exposed area comprises successively retracting panels of the first and second covers to the folded condition away from the exposed area of the facility.

23. The method of claim 22, wherein spreading the first and second covers over the exposed area in the unfolded condition comprises successively extending the panels of the first and second covers in the unfolded condition over the exposed area of the facility.

24. The method of claim 20, wherein driving couplings on edges of the first and second covers along the longitudinal rails between the folded and unfolded conditions comprises:

driving a pinion gear disposed on the coupling along a rack gear disposed on the longitudinal rail;

operating a traction drive system; or operating a cable drive system.

25. The method of claim 20, wherein inflating and deflating the first and second covers of the flexible structure comprises supporting the first and second covers using first and second cables affixed respectively to the first and second covers of the flexible structure.

26. The method of claim 20, further comprising supporting the flexible structure with lateral struts disposed between the couplings at the edges of the flexible structure.

27. The method of claim 20, wherein inflating the first and second covers of the flexible structure comprises operating a plurality of blowers disposed along at least one of the edges of the first and second covers and blowing air in at least one plenum between the first and second covers.

28. The method of claim 20, wherein running the first and second covers comprises extending or folding longitudinal cables connected at the edges of the first and second covers between the couplings.

29. A structure to cover an exposed area of a facility, the structure comprising:

a flexible first cover;

a flexible second cover disposed adjacent the flexible first cover;

a plurality of lateral supports extending from first edge to edge along the flexible first and second covers; and couplings disposed along the edges of the flexible first and second covers and connected to ends of the lateral supports, first longitudinal cables disposed along the edges of the flexible first cover and connected to the couplings;

second longitudinal cables disposed along the edges of the flexible second cover and connected to the couplings, wherein the flexible first and second covers define at least one plenum adapted to inflate the flexible first and second covers relative to one another.

30. The structure of claim 29, wherein the structure deploys as a roof to cover the exposed area of the facility, and wherein the flexible second cover is a bottom cover disposed beneath a flexible top cover as the flexible first cover.

31. The structure of claim 29, wherein the flexible first and second covers are adapted to fold in a retracted condition away from the exposed area of the facility and to deploy in an extended condition over the exposed area of the facility.

32. The structure of claim 31, further comprising rails disposed along the edges of the flexible first and second covers, the couplings adapted to ride along the rails between the retracted and extended conditions.

33. The structure of claim 29, wherein the flexible first and second covers comprises a plurality of flexible panels arranged laterally from edge to edge.

34. The structure of claim 29, wherein the lateral supports comprise first and second cables affixed to the couplings and affixed respectively to the flexible first and second covers.

35. The structure of claim 29, wherein the lateral supports comprise lateral struts disposed between the couplings at the edges of the flexible first and second covers.

36. The structure of claim 29, further comprising a plurality of blowers disposed along at least one of the edges of the flexible first and second covers and adapted to blow air in the at least one plenum between the flexible first and second covers.

* * * * *